US007312782B2

(12) United States Patent
Hiraki et al.

(10) Patent No.: US 7,312,782 B2
(45) Date of Patent: Dec. 25, 2007

(54) LIQUID CRYSTAL DISPLAY DEVICE

(75) Inventors: Katsuyoshi Hiraki, Kawasaki (JP); Tetsuya Kobayashi, Kawasaki (JP); Yasutake Furukoshi, Kawasaki (JP)

(73) Assignees: Fujitsu Limited, Kawasaki (JP); AU Optronics Corporation, Hsinchu (TW)

( * ) Notice: Subject to any disclaimer, the term of this patent is extended or adjusted under 35 U.S.C. 154(b) by 645 days.

(21) Appl. No.: 10/901,668

(22) Filed: Jul. 29, 2004

(65) Prior Publication Data

US 2005/0083280 A1 Apr. 21, 2005

(30) Foreign Application Priority Data

Oct. 20, 2003 (JP) ..... 2003-359733

(51) Int. Cl.
*G09G 3/36* (2006.01)
*H05B 37/00* (2006.01)

(52) U.S. Cl. ..... 345/102; 345/87; 345/102

(58) Field of Classification Search ..... 345/87, 345/102

See application file for complete search history.

(56) References Cited

U.S. PATENT DOCUMENTS 6,815,904 B2 * 11/2004 Choi ..... 315/169.3
6,906,691 B2 * 6/2005 Park et al. ..... 345/89
6,963,179 B2 * 11/2005 Yu et al. ..... 315/318

FOREIGN PATENT DOCUMENTS

JP 2002-006815 1/2002

* cited by examiner

*Primary Examiner*—Richard Hjerpe
*Assistant Examiner*—My-Chau T. Tran
(74) *Attorney, Agent, or Firm*—Greer, Burns & Crain, Ltd.

(57) ABSTRACT

A backlight driving circuit is controlled by a timing controller and executes on/off control of the backlights. The timing controller detects, using a synchronous signal, a change in a blank period which is of one frame period for display of one screen, during which the image signal is not transmitted. Upon detecting the change in the blank period, the timing controller adjusts the on-periods of the backlights in order to make the brightness of the backlights equal to one another. Consequently, the backlights have an equal brightness with one another in spite of the change in the blank period. This makes the lives of the backlights equal to one another. In a case where the plural backlights constitute a backlight unit, a reduction in life of the backlight unit is prevented. Further, it is also possible to prevent the brightness of the backlights from being differentiated even through a long-term use.

27 Claims, 24 Drawing Sheets

Prior Art

Prior Art

Prior Art

Prior Art

LIQUID CRYSTAL DISPLAY DEVICE

CROSS REFERENCE TO RELATED APPLICATION

This application is based upon and claims the benefit of priority from Japanese Patent Application No. 2003-359733, filed on Oct. 20, 2003, the entire contents of which are incorporated herein by reference.

BACKGROUND OF THE INVENTION

1. Field of the Invention

The present invention relates to a liquid crystal display device having backlights.

2. Description of the Related Art

Liquid crystal display devices are in wide use for display devices of notebook personal computers and desktop personal computers since their power consumption is small and they require only small installation space. In recent years, liquid crystal display devices for television have been developed and are increasing their share of the market. Further, personal computers usable for viewing television broadcasting are being developed.

When they are used for television, improvement in display quality of moving images is especially demanded. As a method for improving display quality of moving images, a driving method of increasing response speed of liquid crystal, a method of on/off driving of backlights, and so on have been proposed. Devising on/off driving of backlights reduces blur of moving images occurring by so-called hold driving (disclosed in Japanese Unexamined Patent Application No. 2002-6815).

FIG. 1 shows a display system constituted of a typical liquid crystal display device having backlights and a control device for controlling the display of an image on the liquid crystal display device. The liquid crystal display device has a timing controller, a liquid crystal panel, and a backlight unit. The backlight unit is constituted of a plurality of backlights BL1 to BL4 and is disposed on a rear face of the liquid crystal panel. The timing controller receives a clock signal, a control signal, an image signal, and so on from the external control device and outputs a driving signal for display of an image on the liquid crystal panel, an image signal, and backlight control signals BLCON1 to BLCON4 for turning on and off the backlights BL1 to BL4 in sequence.

When the display system is a personal computer system, the control device is constituted of a control board mounted in a personal computer. This kind of control device has a function of converting image sources (video, DVD, television signals and so on) to signals with various resolutions and frequencies. The control device temporarily stores the image signal in a not-shown line memory or frame memory, so that it is capable of freely setting the output timing of the image signal and the control signal.

FIG. 2 shows one example of on/off control of the backlights in FIG. 1. In this example, the number of horizontal lines of the liquid crystal panel is 768. Therefore, each of the backlights BL1, BL2, BL3, BL4 is disposed for every 192 horizontal lines of the liquid crystal panel. One frame period for displaying one screen is constituted of a period for transmission of the image signal and a blank period BLANK that is a period up to the head of a subsequent frame from the transmission of the image signal. The control device selects not-shown 192 scanning lines in sequence to write the image signal to liquid crystal cells of each horizontal line. Further, the control device lights the backlights BL1, BL2, BL3, BL4 in sequence in synchronization with the write of the image signal to the scanning lines 1 to 192, 193 to 384, 385 to 576, 577 to 768. In this example, the backlight BL1 (or BL2, BL3, BL4) illuminates for a predetermined period immediately before an image signal of a subsequent frame is written to the corresponding scanning lines 1 to 192 (or 193 to 384, 385 to 576, 577 to 768).

The timing controller starts turning on the backlights BL1 to BL4 in synchronization with the driving of predetermined horizontal lines (L1 to L4) so that lighting periods ON of the backlights BL1 to BL4 are equal to one another. Specifically, the timing controller asserts the backlight control signal BLCON1 low in synchronization with the driving of the horizontal line L1. Similarly, the timing controller asserts the backlight control signals BLCON2 to BLCON4 low in synchronization with the driving of the horizontal lines L1, L2, L3, respectively. The backlights BL1 to BL4 illuminate during low level periods of the backlight control signals BLCON1 to BLCON4 respectively.

The backlights BL1 to BL4 are turned off immediately before a subsequent frame image is displayed as described above. Specifically, the timing controller negates the backlight control signals BLCON1 to BLCON4 high in order to turn off the backlights BL1 to BL4 when the driven horizontal lines are 1, 193, 385, 577, respectively. Thus, the turning-on timing and turning-off timing of each of the backlights BL1 to BL4 are determined by the horizontal line numbers set in advance.

When the display system is a personal computer system, the output timings of the image signal and the control signal are generally changeable by the design of a personal computer manufacturer, users options, and so on. For example, when the output repetition rate of the image signal is to be made higher, the blank period BLANK becomes longer even with the same one frame period.

FIG. 3 shows another example of the on/off control of the backlights in FIG. 1. One frame period is the same as that in FIG. 2, but due to the higher output repetition rate of the image signal, the blank period BLANK is longer than that in FIG. 2. Transition edges of the backlight control signals BLCON1 to BLCON4 are generated in synchronization with the driving timings of the horizontal lines set in advance. Consequently, lighting periods ON of the backlight control signals BLCON1, BLCON2 whose lighting periods ON overlap the blank period BLANK is longer. On the other hand, the lighting periods ON of the backlight control signals BLCON3, BLCON4 whose lighting periods ON do not overlap the blank period BLANK become shorter. As a result, an upper half of the liquid crystal panel facing the backlights BL1, BL2 has higher brightness and a lower half of the liquid crystal panel facing the backlights BL3, BL4 has lower brightness.

Further, the life of the backlights BL1 to BL4 depends on how long they illuminate. Therefore, the life of the backlights BL1, BL2 having longer lighting periods ON is shorter compared with the life of the backlights BL3, BL4 having shorter lighting periods ON. The backlights BL1 to BL4 are not replaceable individually since they are integrally structured as the backlight unit. Therefore, if any one of the backlights BL1 to BL4 is of no use, the entire backlight unit needs to be replaced. This means that the life of the backlight unit depends on the backlight having a longer lighting period ON, and the longer the period, the shorter the life. Further, brightness of the backlights BL1 to BL4 while they are on slightly lowers depending on the length of the lighting period ON thereof. Therefore, if the backlights BL1 to BL4 have different lighting periods ON, brightness of the backlights BL1 to BL4 while they are on will be differentiated through the long-term use.

FIG. 4 shows change in brightness of the backlights BL1 to BL4. The backlight BL (one of BL1 to BL4) turns on in synchronization with a falling edge of the backlight control signal BLCON (one of BLCON1 to BLCON4). At this time, there is a transition period TP1 before the brightness increases to its maximum value. Similarly, there is a transition period TP2 that is from a rising edge of the backlight control signal BLCON to an instant when the backlight BL turns off completely and brightness turns to zero.

The transition periods TP1, TP2 are characteristics peculiar to the backlight BL and they are constant irrespective of a refresh rate signifying one frame period and. Therefore, when the refresh rate is higher, a ratio of a stable period SP to a low level period (ON period in the drawing) of the backlight control signal BLCON is relatively low. In other words, even when the sum of the low level periods of the backlight control signal BLCON in a predetermined period is independent from the refresh rate and is constant, the brightness of the backlight BL (an integral value of the waveform in the drawing) is lower as the refresh rate is higher. As a result, for example, if a user of a personal computer manually sets a higher refresh rate, a screen of the liquid crystal display device becomes darker.

Further, a liquid crystal display device adopting a technique of on/off driving the backlights BL has a problem that the on/off period appears as flicker. The flicker is not conspicuous when an image in various colors displayed. But when an image with small motion is displayed (such as a case where a single color images over a plurality of frames is displayed on a part of a screen, the flicker is conspicuous.

SUMMARY OF THE INVENTION

It is an object of the present invention to prevent a change in brightness of a backlight of a liquid crystal display device even when a blank period changes.

It is another object of the present invention to prevent occurrence of a difference in brightness of a plurality of backlights of a liquid crystal display device even when a blank period changes.

It is still another object of the present invention to prevent a change in brightness of a backlight of a liquid crystal display device and to reduce flicker.

According to one of the aspects of the liquid crystal display device of the present invention, the liquid crystal display device has a liquid crystal panel in which a liquid crystal cell is arranged at intersecting areas of scanning lines and data lines. A plurality of backlights are disposed to face the liquid crystal panel and arranged in line in a wiring direction of the data lines. An image signal and a synchronous signal for generation of driving timings for the scanning lines and the data lines are supplied via external terminals respectively. A backlight driving circuit is controlled by a timing controller and execute on/off control of the backlights. The timing controller detects, using the synchronous signal, change in a blank period which is of one frame period for display of one screen and during which the image signal is not transmitted. Upon detecting the change in the blank period, the timing controller adjusts on-periods of the backlights in order to make brightness of the backlights equal to one another. Consequently, the backlights have equal brightness with one other in spite of the change in the blank period. This makes the lives of the backlights equal to one another. In a case where the plural backlights constitute a backlight unit, it is able to prevent reduction in life of the backlight unit. Further, it is also possible to prevent brightness of the backlights from being differentiated even through a long-term use.

According to another aspect of the liquid crystal display device of the present invention, the timing controller has a blank-line detecting unit and a timing calculating unit. The blank-line detecting unit finds the number of blank lines corresponding to the blank period, the number of blank lines being represented by the number of horizontal periods that are generation periods for the synchronous signal. The timing calculating unit finds the number of frame lines corresponding to one frame period by adding the number of blank lines to the number of horizontal lines that is the number of scanning lines, thereby setting a turning-on timing and turning-off timing of each of the backlights to serial numbers assigned to the frame lines. This can reduce the maximum value of the serial numbers which the blank-line detecting unit and the timing calculating unit handle. As a result, downsizing of, for example, a counter and so on and reduction in circuit scale of the timing controller are made possible. Further, it is able to reduce power consumption of the timing controller.

According to another aspect of the liquid crystal display device of the present invention, the timing controller has a blank dividing unit. The blank dividing unit divides the number of blank lines by the number of backlights to find the number of divided blank lines that is the number of blank lines per one backlight. The on-period of each of the backlights is represented by the number of illuminating frame lines that is a difference between the serial numbers indicating the turning-off timing and the turning-on timing, respectively. The timing calculating unit sets the number of illuminating frame lines to a sum of a preset number of lines and the number of divided blank lines. Dividing the blank period by the number of backlights and allotting the divided periods tp the respective on-periods of the backlights makes it possible to keep constant a ratio of the on-period to one frame period even when the blank period changes. If one frame period does not change, the on-period is constant, so that change in brightness due to the change in the blank period can be eliminated. For example, if there is a remainder after the division of the blank period by the number of backlights, the remainder is rounded off or rounded up, which can reduce circuit scale.

According to another aspect of the liquid crystal display device of the present invention, an external clock signal for putting the timing controller into operation is supplied via an external terminal. The timing controller has an image detecting unit, a blank-clock detecting unit, and a timing calculating unit. The image detecting unit finds the length of an image period which is of one frame period and during which the image signal is transmitted, as the number of clocks of the external clock signal. The blank-clock detecting unit finds the length of the blank period as the number of clocks of the external clock signal. The timing calculating unit adds the number of clocks counted by the blank-clock detecting unit to the number of clocks counted by the image detecting unit to find the number of frame clocks corresponding to one frame period, thereby setting a turning-on timing and a turning-off timing of each of the backlights by using serial numbers assigned to the frame clocks. Setting the turning-on timing and the turning-off timing using the numbers of the clocks of the external clock signal enables precise adjustment of the on-periods of the backlights.

According to another aspect of the liquid crystal display device of the present invention, the liquid crystal display device has an oscillator which generates an internal clock signal. The timing controller has an image detecting unit, a blank-clock detecting unit, and a timing calculating unit. The image detecting unit finds the length of an image period during which is of one frame period and during which the image signal is transmitted, as the number of clocks of the internal clock signal. The blank-clock detecting unit finds the length of the blank period as the number of clocks of the internal clock signal. The timing calculating unit adds the number of clocks counted by the blank-clock detecting unit to the number of clocks counted by the image detecting unit to find the number of frame clocks corresponding to one frame period, thereby setting a turning-on timing and a turning-off timing of each of the backlights by using serial numbers assigned to the frame clocks. Setting the turning-on timing and the turning-off timing using the number of clocks of the internal clock signal, makes it possible to keep constant the on-periods of the backlights corresponding to the number of clocks. As a result, the backlights can have constant brightness when not only the blank period but also the frame period change. For example, setting the frequency of the internal clock signal to a value lower than that of the external clock makes it possible to relatively reduce circuit scale of the timing controller, resulting in relative reduction in the power consumption.

According to another aspect of the liquid crystal display device of the present invention, a frequency divider divides a frequency of an external clock signal supplied via an external terminal to generate an internal clock signal. The timing controller has an image detecting unit, a blank-clock detecting unit, and a timing calculating unit. The image detecting unit finds the length of an image period which is of one frame period and during which the image signal is transmitted, as the number of clocks of the internal clock signal. The blank-clock detecting unit finds the length of the blank period as the number of clocks of the internal clock signal. The timing calculating unit adds the number of clocks counted by the blank-clock detecting unit to the number of clocks counted by the image detecting unit to find the number of frame clocks corresponding to one frame period, thereby setting a turning-on timing and a turning-off timing of each of the backlights using serial numbers assigned to the frame clocks. Setting the turning-on timing and the turning-off timing using the number of clocks of the internal clock signal that is generated by dividing the frequency of the external clock signal makes it possible to relatively reduce circuit scale of the timing controller, resulting in relative reduction in the power consumption compared with a case where an external clock signal is used.

According to another aspect of the liquid crystal display device of the present invention, the timing calculating unit sets the turning-off timings of the backlights so that in respective display areas of the liquid crystal panel corresponding to the backlights, brightness of the backlights lowers to an off-level brightness before display of an image signal of a subsequent frame is started. Consequently, it is possible to prevent appearance of an image of a subsequent frame while the backlights are on for display of an image of a certain frame. Therefore, it is able to prevent a moving image and so on from blurring.

According to another aspect of the liquid crystal display device of the present invention, a frame-head detecting unit outputs a detecting signal when detecting a head of each frame. One of the backlights corresponding to a head horizontal line is turned off in synchronization with an earlier timing between the turning-off timing found by the timing calculating unit and an output timing of the detecting signal. Consequently, the backlight can be surely turned off by the detecting signal even when one frame period is so short that there is no serial line needed for turning off the backlights. This can prevent a single backlight corresponding to the head horizontal line from continuously illuminating during one frame period. In other words, it is able to prevent brightness of the backlights from becoming different from one another.

(24, 25) According to another aspect of the liquid crystal display device of the present invention, an image analyzing unit outputs a flicker preventing signal when an image formed of image signals of a plurality of frames is in small motion. Alternatively, the flicker preventing signal is supplied via an external terminal. A backlight driving circuit stops the on/off control in response to the output of the flicker preventing signal so that the backlights continuously illuminates with predetermined brightness. For display of a slightly moving image in which flicker is conspicuous, the on/off control is stopped so as to keep the backlights illuminating with predetermined brightness, so that the occurrence of the flicker is made preventable.

BRIEF DESCRIPTION OF THE DRAWINGS

The nature, principle, and utility of the invention will become more apparent from the following detailed description when read in conjunction with the accompanying drawings in which like parts are designated by identical reference numbers, in which.

DESCRIPTION OF THE PREFERRED EMBODIMENTS

Figure 1:
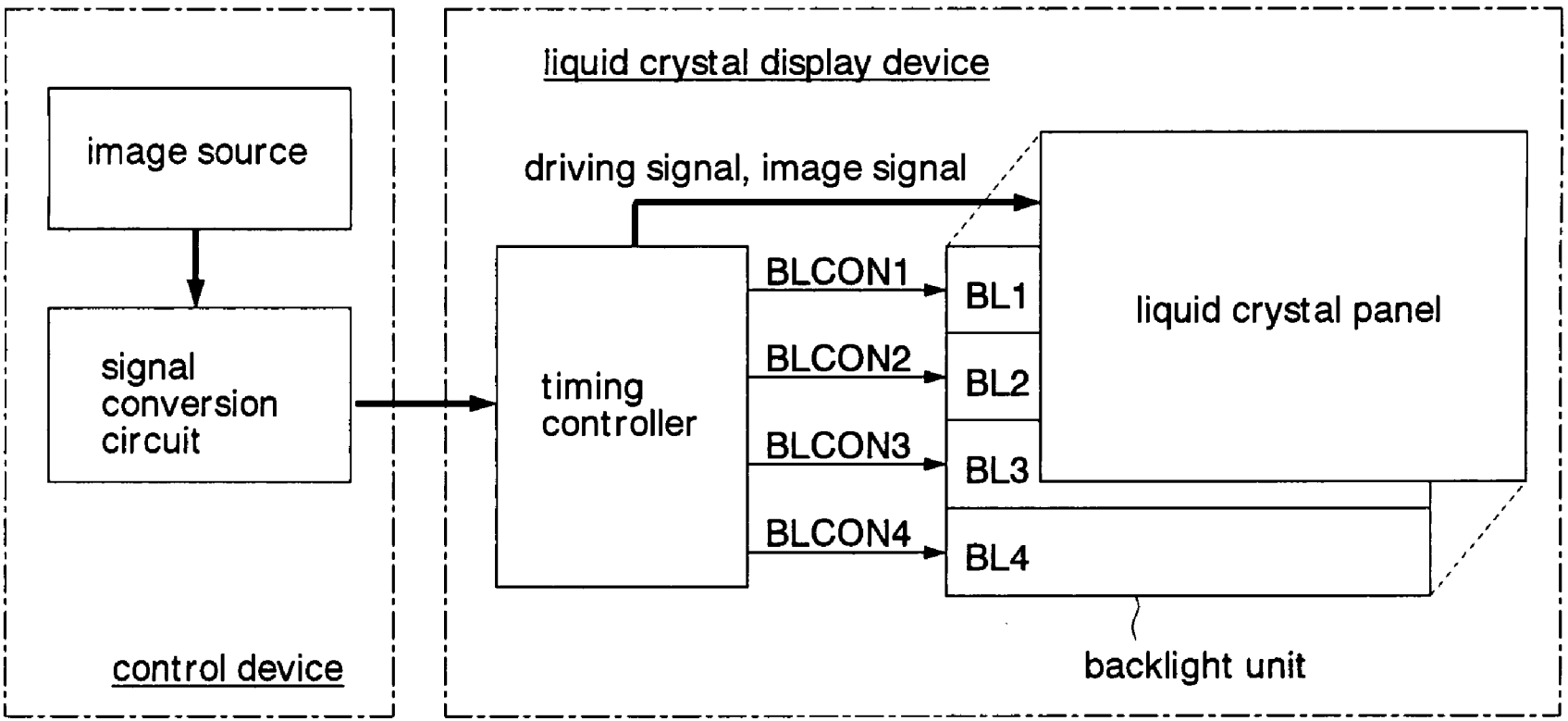
FIG. 1 is block diagram showing a conventional display system constituted of a typical liquid crystal display device having backlights and a control device for controlling the display of an image on the liquid crystal display device.
Figure 2:
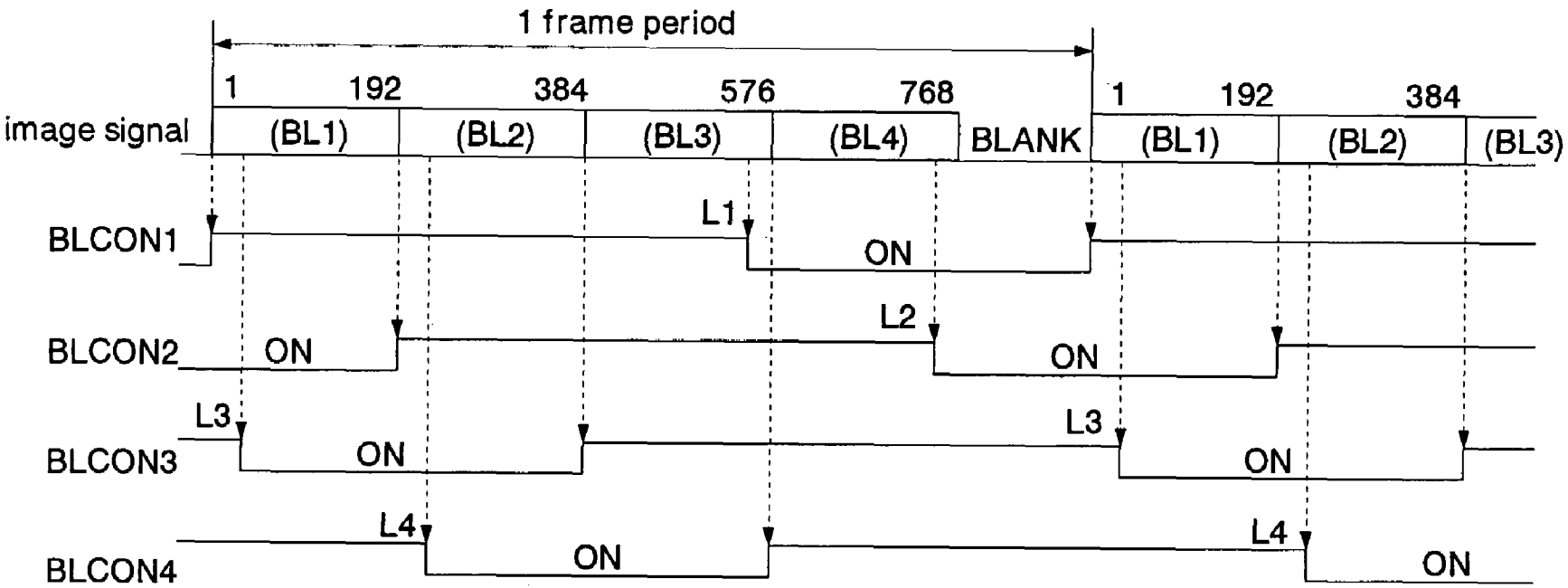
FIG. 2 is a timing chart showing one example of on/off control of the backlights in FIG. 1.
Figure 3:
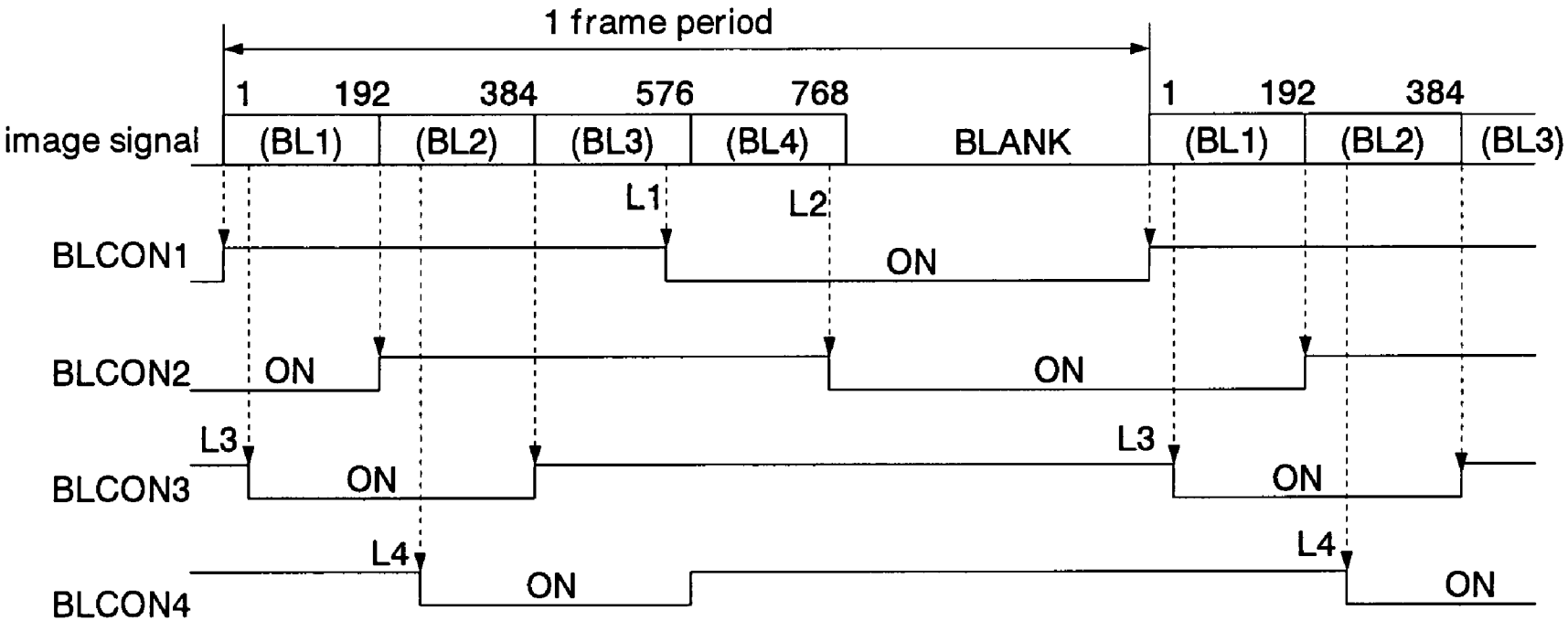
FIG. 3 is a timing chart showing another example of the on/off control of the backlights in FIG. 1.

Hereinafter, embodiments of the present invention will be described with reference to the drawings. The double circles in the drawings represent external terminals. In the drawings, each signal line shown by the heavy line is constituted of a plurality of lines.

Further, part of a block to which the heavy line is connected is constituted of a plurality of circuits. The same reference numerals and symbols as those of the external terminals are used to designate signals supplied via the external terminals. The same reference numerals and symbols as those of the signals are used to designate signal lines through which the signals are transmitted.

Figure 5:
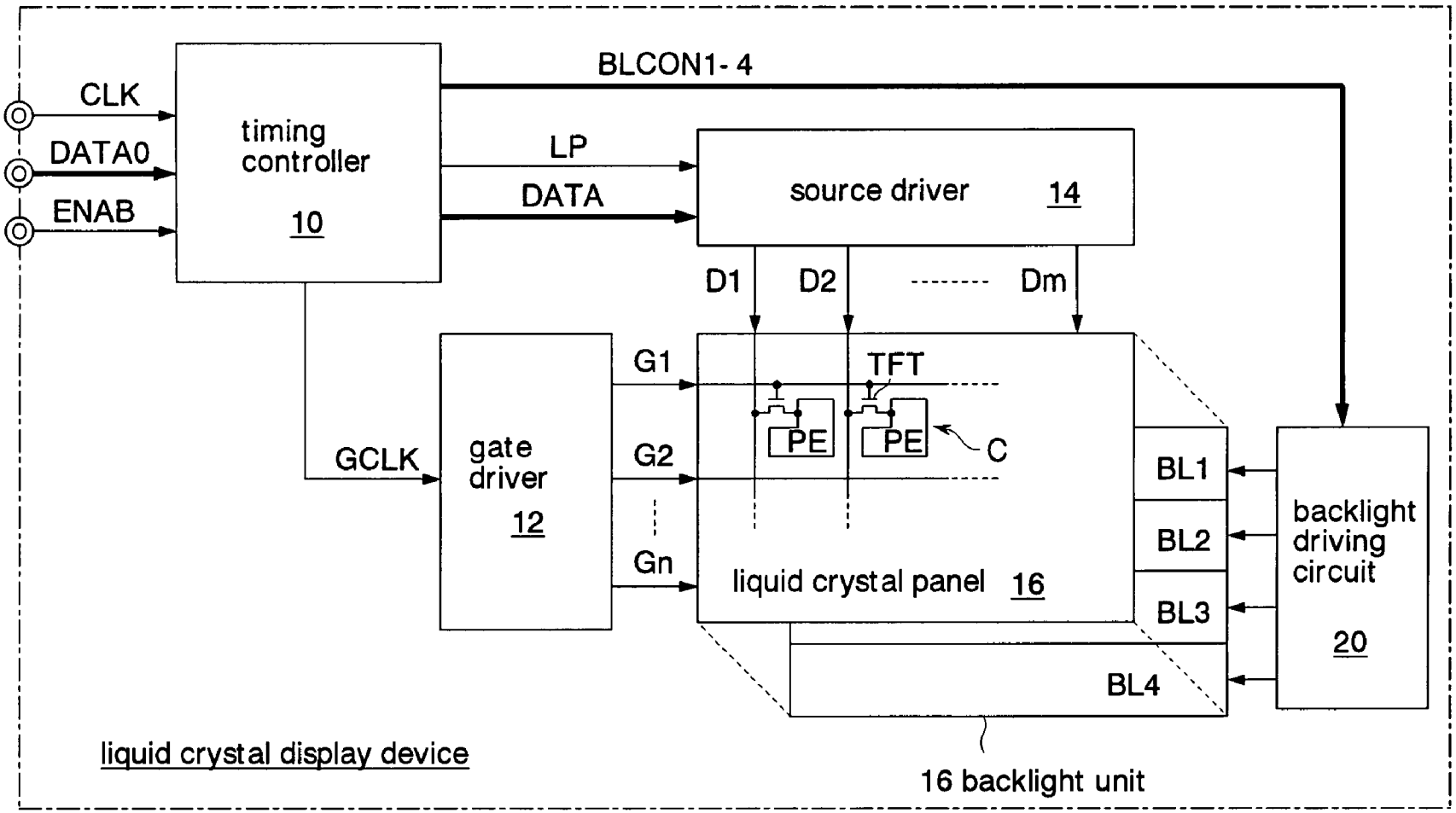
FIG. 5 is a block diagram showing a first embodiment of the present invention.

FIG. 5 shows a first embodiment of the present invention. In this embodiment, a liquid crystal display device is connected to a not-shown control device such as a personal computer. The liquid crystal display device has the plural external terminals receiving signals from the personal computer. The personal computer has the same function as that of, for example, the control device shown in FIG. 1. The liquid crystal display device has a timing controller 10, a gate driver 12, a source driver 14, a liquid crystal panel 16, a backlight unit 18, and a backlight driving circuit 20.

The timing controller 10 receives via the external terminals a clock signal CLK (external clock signal=dot clock signal), a data signal DATA0 (image signal), and an enable signal ENAB (synchronous signal) respectively to output a gate clock signal GCLK to the gate driver 12, a latch pulse signal LP and a data signal (image signal) DATA to the source driver 14, and backlight control signals BLCONS1 to BLCONS4 to the backlight driving circuit 20. The clock signal CLK functions as a basic clock signal for putting the timing controller 10 into operation. The enable signal ENAB is a synchronous signal for dividing the data signal DATA0 for each horizontal line as will be described later. The gate clock signal GCLK and the latch pulse signal LP are generated in synchronization with the enable signal ENAB. The data signal DATA has the same information as that of the data signal DATA0. The backlight control signals BLCON1 to BLCON4 are signals for turning on and off the backlights BL1 to BL4 respectively. The timing controller 10 will be explained in FIG. 6 in detail. The gate driver 12 outputs gate pulses to scanning lines G1 to Gn in sequence in synchronization with the gate clock signal GCLK. The source driver 14 receives the data signal DATA from each of the horizontal lines in sequence in synchronization with the latch pulse signal LP and outputs the received signals to data lines D1 to Dm. The latch pulse signal LP is generated 768 times in one frame period.

The liquid crystal panel 16 has liquid crystal cells C formed at intersecting areas of the scanning lines G1 to Gn and the data lines D1 to Dm respectively. Each of the liquid crystal cells C is constituted of a thin film transistor TFT, a pixel electrode PE, and a not-shown liquid crystal and counter electrode. A gate of each of the thin film transistors TFT is connected to one of the scanning lines G1 to Gn, a drain thereof is connected to one of the data lines D1 to Dm, and a source thereof is connected to the pixel electrode PE. The counter electrode is disposed to face the pixel electrode PE. Further, liquid crystal is sandwiched by the pixel electrode PE and the counter electrode to constitute the liquid crystal cell C. The number of the scanning lines is 768 (n=768) in this embodiment. The liquid crystal cells C arranged along the scanning lines G1 to Gn constitute 768 horizontal lines.

The backlight unit 18 is constituted of the four backlights BL1 to BL4 arranged in line in the wiring direction of the data lines D1 to Dm and is disposed on a rear face of the liquid crystal panel 16 to face the liquid crystal panel 16. Each of the backlights BL1 to BL4 is constituted of, for example, a not-shown fluorescent tube and optical waveguide. Each of the backlights BL1 to BL4 is disposed for every 192 horizontal lines in the liquid crystal panel 16.

Figure 4:
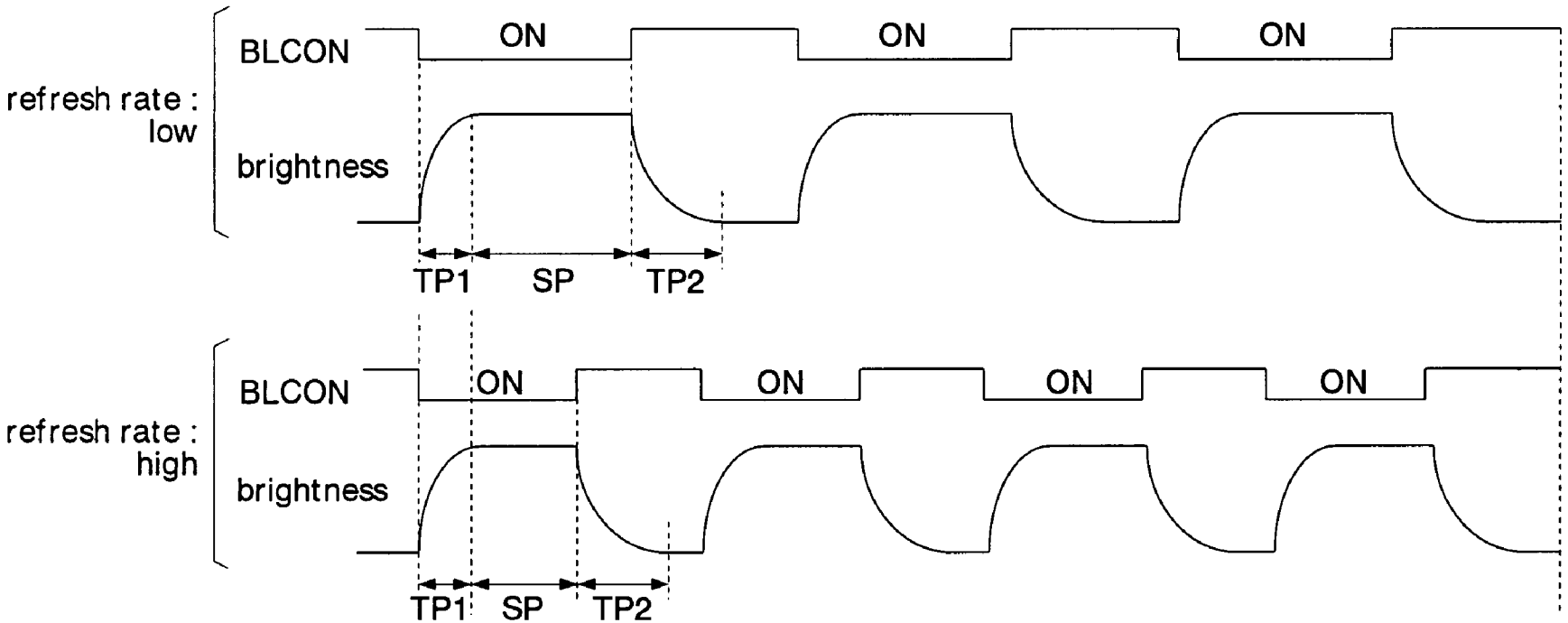
FIG. 4 is a waveform chart showing change in brightness of the backlights.

The backlight driving circuit 20 is constituted of an inverter for driving the fluorescent tubes. The backlight control circuit 20 outputs driving signals for turning on or off the fluorescent tubes of the backlights BL1 to BL4, in response to the backlight control signals BLCON1 to BLCON4 outputted from the timing controller 10. Note that, in this embodiment, the backlight driving circuit 20 turns on each of the fluorescent tubes with the maximum brightness when the logic level of each of the backlight control signals BLCON1 to BLCON4 indicates turn-on (low level), and lights each of the fluorescent tubes with 5% brightness (low brightness) of the maximum brightness when the logic level of each of the backlight control signals BLCON1 to BLCON4 indicates turn-off (high level). The fluorescent tubes are kept on with low brightness while the backlights BL1 to BL4 are off, so that they can be turned on next with quick increase in brightness. Therefore, the aforementioned transition period TP1 shown in FIG. 4 can be shortened to increase a ratio of stable periods SP to lighting periods of the backlights BL1 to BL4. Brightness of the backlights BL1 to BL4 at the turn-on level and the turn-off level are set in the same manner as in second to six, ninth, and tenth embodiments to be described later. Hereinafter, the tuning-on and turning-off of the fluorescent tubes will be explained simply as turning-on and turning-off of the backlights BL1 to BL4.

Figure 6:
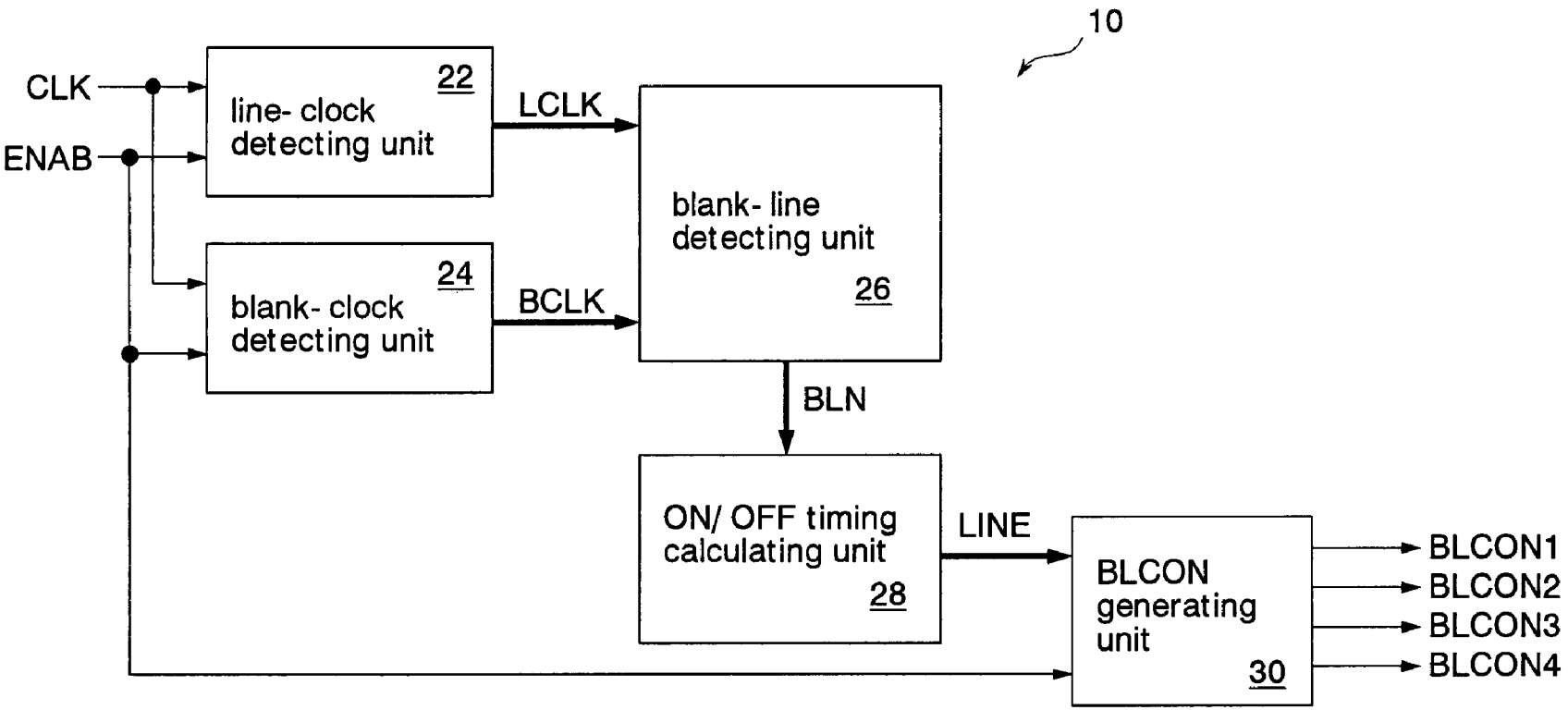
FIG. 6 is a block diagram showing a timing controller shown in FIG. 5 in detail.

FIG. 6 shows the timing controller 10 shown in FIG. 5 in detail. The timing controller 10 has a line-clock detecting unit 22, a blank-clock detecting unit 24, a blank-line detecting unit 26, an ON/OFF timing calculating unit 28, and a BLCON generating unit 30.

The line-clock detecting unit 22 finds the length of a generation period (pulse interval) of the enable signal ENAB using the number of clocks (the number of pulses) of the clock signal CLK. Specifically, the line-clock detecting unit 22 counts the number of the clocks in one horizontal line period (generation period of the enable signal ENAB), and outputs a line-clock signal LCLK indicating the found number of the clocks. The line-clock signal LCLK indicates the counted number of the clocks in binary number.

Note that the line-clock detecting unit 22 may count the number of the clocks of each of the plural horizontal line periods, find the average number of the clocks using only the number of the clocks existing in a predetermined range, and output the line-clock signal LCLK indicating the found number of the clocks. In this case, if the number of the clocks is not normal due to noises and so on, it will be excluded so that abrupt change in brightness of the backlights BL1 to BL4 can be prevented.

The blank-clock detecting unit 24 finds the length of a blank period BLANK in one frame as the number of clocks of the clock signal CLK. The blank period BLANK is a period which is of one frame period and during which an image signal is not transmitted, and is a period up to the start of a subsequent frame from the output of all the data signals DATA for one frame. For example, the blank period BLANK is detected when the pulse of the enable signal ENAB does not occur for a predetermined length of period or longer. The blank-clock detecting unit 24 outputs the found number of the clocks as a blank-clock signal BCLK. The blank-clock signal BCLK shows the found number of the clocks as a binary number.

The blank-line detecting unit 26 divides the number of the clocks (BCLK) indicated by the blank-clock signal BCLK by the number of the clocks (LCLK) indicated by the line-clock signal (LCLK) to find the number of horizontal lines (the number of blank lines) corresponding to the blank period BLANK, and outputs the found number of the horizontal lines as a blank-line signal BLN. Therefore, a clock-number ratio BCLK/LCLK is set as the number of the blank lines. The blank-line signal BLN shows the number of the blank lines as a binary number.

The ON/OFF timing calculating unit 28 receives the blank-line signal BLN to calculate the turning-on timing and the turning-off timing of each of the backlights BL1 to BL4. Specifically, the ON/OFF timing calculating unit 28 first adds the number of the blank lines to the number the horizontal lines that is the number of the scanning lines G1 to G768 to calculate the number of horizontal lines (the number of frame lines) corresponding to one frame period. The found frame lines are assigned line numbers (serial numbers) starting from "1" in sequence. The number of the scanning lines G1 to G768 of the liquid crystal panel 16 is a proper value of the liquid crystal panel 16. Therefore, the number of the frame lines is a value equal to the sum of 768 lines and the number of the blank lines indicated by the blank-line signal BLN. For example, when the blank-line signal BLN indicates 32 lines, one frame period corresponds to 800 lines.

In this embodiment, the ON/OFF timing calculating unit 28 sets the lighting period ON of each of the backlights BL1 to BL4 to 192 lines in advance. Therefore, the ON/OFF timing calculating unit 28 allots 192 lines to the lighting period ON out of the number of the horizontal lines (for example, 800 lines) of one frame period. This means that the difference between the line numbers for turning off and on each of the backlights BL1 to BL4 is always kept constant. Then, the ON/OFF timing calculating unit 28 calculates the line numbers for turning on and off each of the backlights BL1 to BL4 to output the calculated values as line signals LINE for the respective backlights BL1 to BL4.

The BLCON generating unit 30 counts the enable signals ENAB to find the horizontal line number. When the found horizontal number matches the line signal LINE, the BLCON generating unit 30 makes the corresponding one of the backlight control signals BLCON1 to BLCON4 fall or rise in order to turn on or off the corresponding one of the backlights BL1 to BL4.

Figure 7:
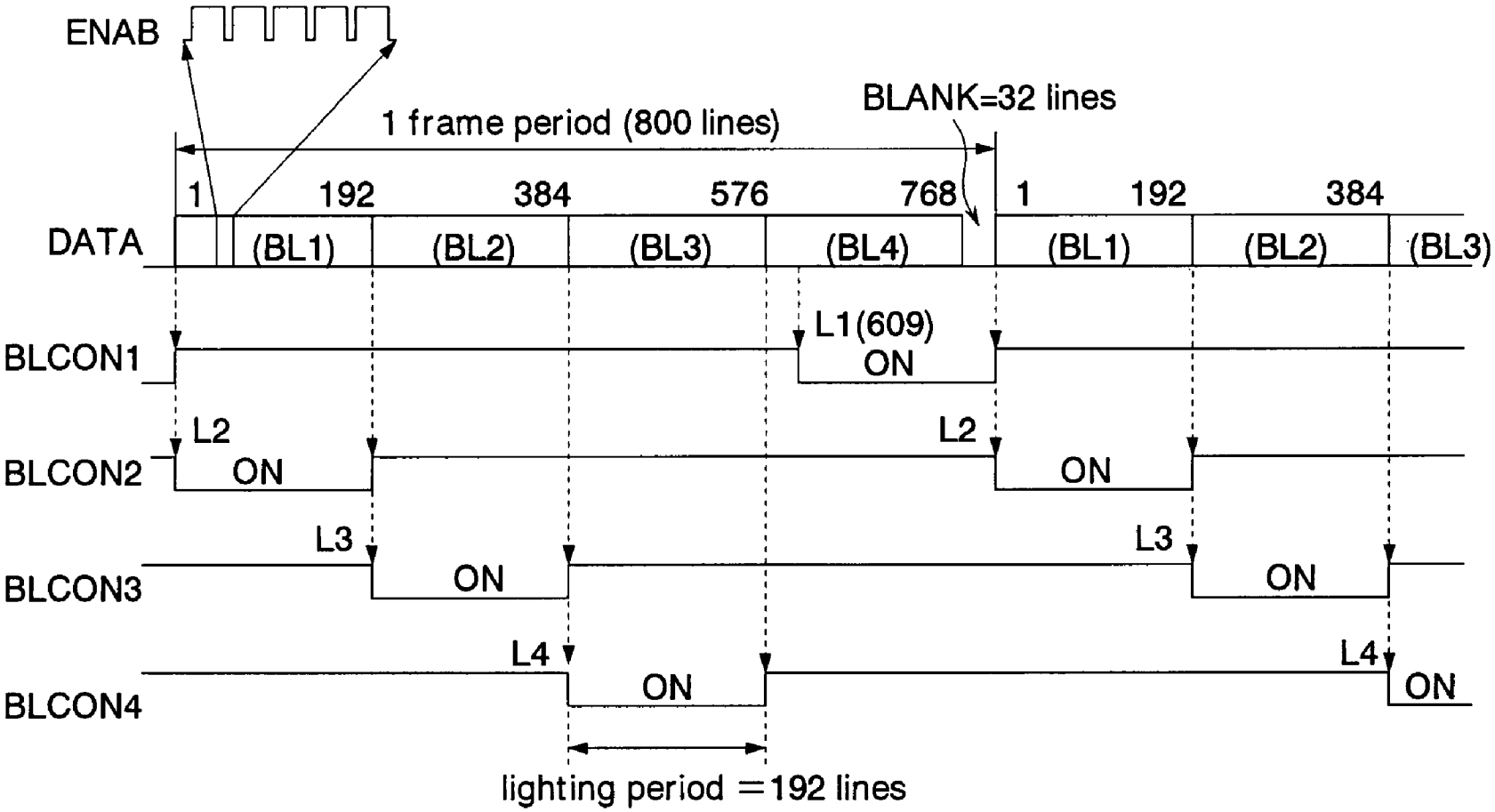
FIG. 7 is a timing chart showing one example of on/off control of backlights in the first embodiment.

FIG. 7 shows one example of on/off control of the backlights BL1 to BL4 in the first embodiment. The enable signal ENAB is a synchronous signal for display of the display data DATA of each of the horizontal lines as described above. In this example, the blank-line detecting unit 26 shown in FIG. 6 judges that the blank period BLANK corresponds to 32 lines. The ON/OFF timing calculating unit 28 judges that one frame period corresponds to 800 lines (768+32) to calculate the horizontal line numbers for turning on and off the backlights BL1 to BL4. The lighting period ON of each of the backlights BL1 to BL4 is set to 192 lines in advance. Therefore, the horizontal line numbers signifying the turning-on timing and the turning-off timing of the backlight BL1 are "609" and "1". The horizontal line numbers signifying the turning-on timings and the turning-off timings of the backlights BL2 to BL4 ("on lines, off lines") are "1, 193", "193, 385", and "385, 577" respectively.

Figure 8:
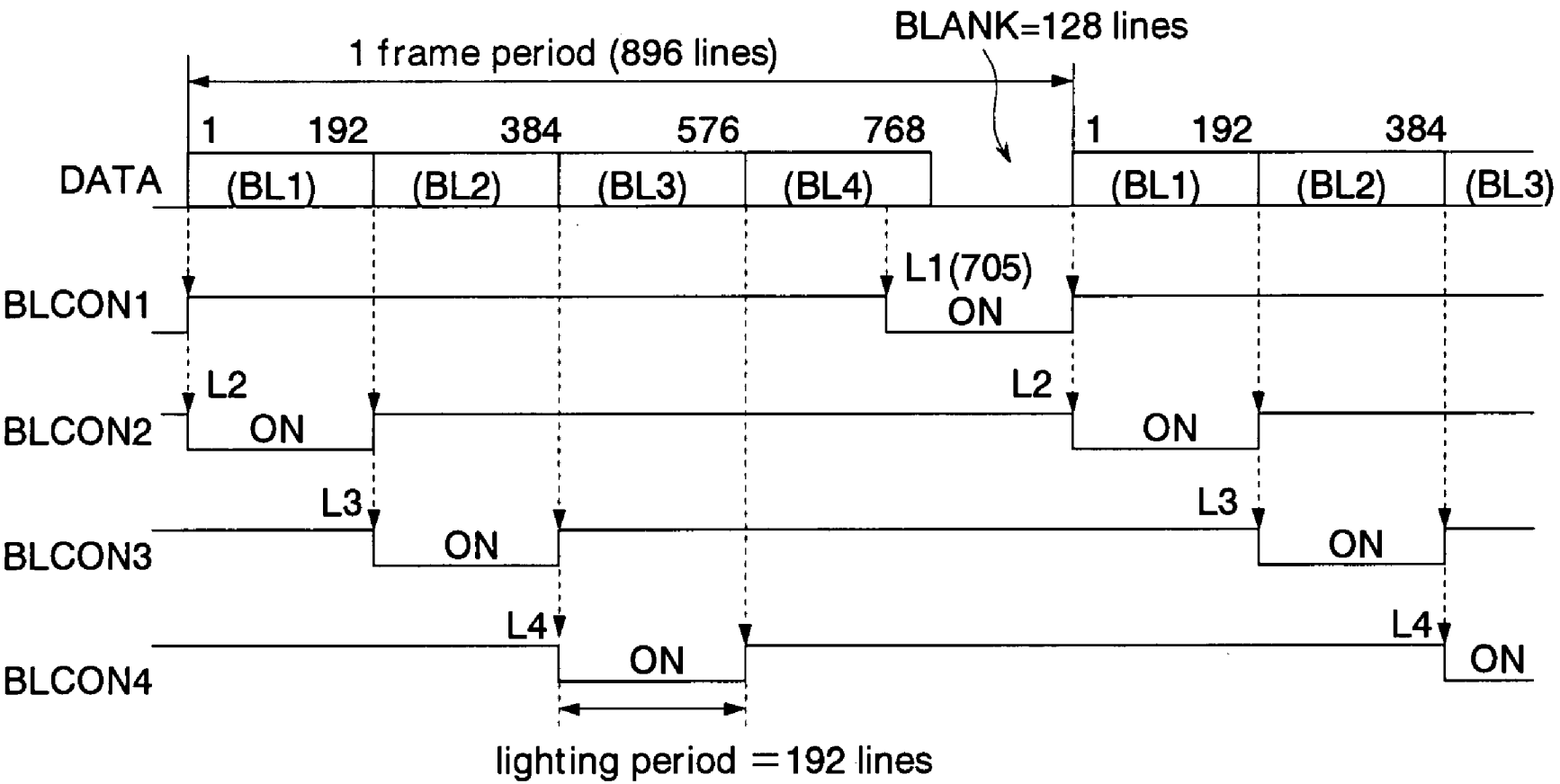
FIG. 8 is a timing chart showing another example of the on/off control of the backlights in the first embodiment.

FIG. 8 shows another example of the on/off control of the backlights BL1 to BL4 in the first embodiment. In this example, the display period of each of the horizontal lines is set shorter by the operation of a user of the personal computer to which the liquid crystal display device of the present invention is connected, so that the blank period BLANK changes from 32 lines in FIG. 7 to 128 lines. The blank-line detecting unit 26 judges that the blank period BLANK corresponds to 128 lines. The ON/OFF timing calculating unit 28 detects that the blank period BLANK has changed from 32 lines to 128 lines to adjust the number of the horizontal lines signifying the lighting period ON of each of the backlights BL1 to BL4.

Specifically, the ON/OFF timing calculating unit 28 judges that one frame period corresponds to 896 lines (768+128) to calculate the horizontal line numbers for turning on and off the backlights BL1 to BL4. The lighting period ON of each of the backlights BL1 to BL4 is set to 192 lines in advance. Therefore, the horizontal line numbers signifying the turning-on timings and the turning-off timings of the backlights BL1 to BL4 ("on lines, off lines") are "705, 1", "1, 193", "193, 385", and "385, 577" respectively. Even when the blank period BLANK is thus changed by the control from an external part of the liquid crystal display device, the lighting period ON of each of the backlights BL1 to BL4 is constantly set to 192 lines. Therefore, difference in brightness of the backlights BL1 to BL4 is prevented even when the blank period BLANK is changed.

In the first embodiment described above, by the adjustment of the lighting period ON of each of the backlights BL1 to BL4 according to the change in the blank period BLANK, the backlights BL1 to BL4 can have the same brightness regardless of the change in the blank period BLANK. As a result, the backlights BL1 to BL4 can have the same length of life, so that the reduction in the life of the backlight unit 18 can be prevented. Even the long-term use of the backlight unit 18 does not cause difference in brightness of the backlights BL1 to BL4.

The turning-on timing and the turning-off timing of each of the backlights BL1 to BL4 are set by the horizontal line numbers, so that the maximum value of the serial number dealt by the timing controller 10 can be made small. Accordingly, a counter and so on formed in the timing controller 10 can be downsized, resulting in the less number of wirings of signal lines. As a result, circuit scale of the timing controller 10 can be reduced to reduce power consumption of the timing controller 10.

Figure 9:
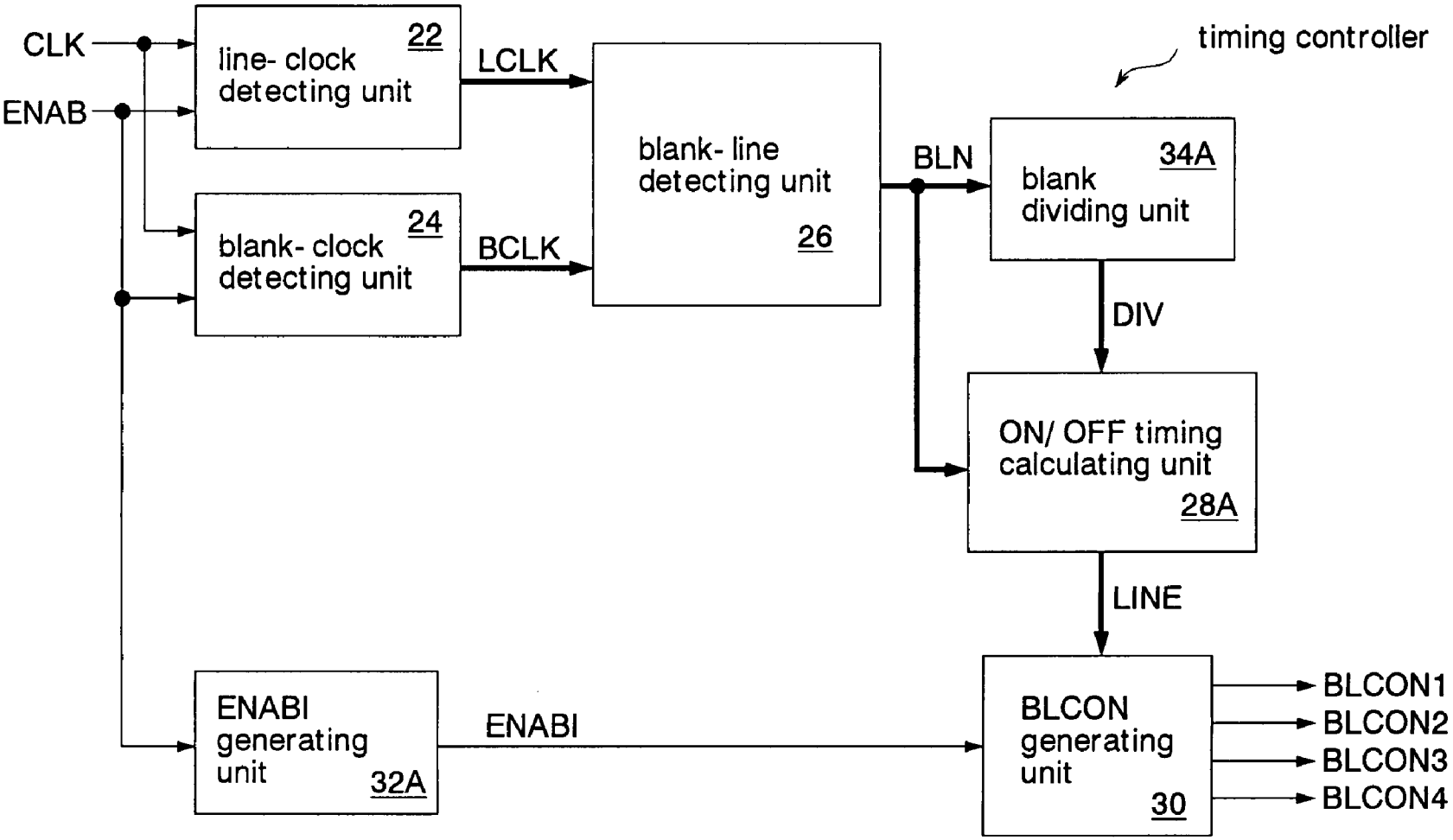
FIG. 9 is a block diagram showing a second embodiment of the present invention.

FIG. 9 shows a second embodiment of the present invention. The same reference numerals and symbols are used to designate the same elements as those explained in the first embodiment, and detailed explanation thereof will be omitted. In this embodiment, a timing controller is different from the timing controller 10 of the first embodiment. The other configuration is the same as that of the first embodiment. Therefore, only the timing controller is shown in FIG. 9.

The timing controller has an ON/OFF timing calculating unit 28A in place of the ON/OFF timing calculating unit 28 of the timing controller 10 (FIG. 6) of the first embodiment. The timing controller further has an ENABI generating unit 32A and a blank dividing unit 34A. The other configuration is substantially the same as that of the timing controller 10 of the first embodiment.

The ENABI generating unit 32A outputs an internal enable signal ENABI synchronizing with an enable signal ENAB. The ENABI generating unit 32A generates the pulse of the internal enable signal ENABI at a same generation cycle as that of the pulse of the enable signal ENAB also in a blank period BLANK. The blank dividing unit 34A receives a blank-line signal BLN indicating the number of horizontal lines corresponding to the blank period BLANK, and in order to equally allot the blank period BLANK to lighting periods ON of respective backlights BL1 to BL4, it divides the number of the horizontal lines indicated by the blank-line signal BLN by "4" that is the number of the backlights BL1 to BL4 to output the division result as a 16-bit dividing signal DIV. Therefore, the dividing signal DIV indicates the number of divided blank lines that is the number of blank lines per one backlight.

The ON/OFF timing calculating unit 28A receives the blank-line signal BLN and the dividing signal DIV to calculate, as in the first embodiment, line numbers (serial numbers) signifying the turning-on timing and the turning-off timing of each of the backlights BL1 to BL4 respectively. Note that the ON/OFF timing calculating unit 28A sets the lighting period of each of the backlights BL1 to BL4 to the number of lines (the number of illuminating frame lines) equal to the sum of an initial value of 192 lines and the number of the divided blank lines indicated by the dividing signal DIV. Specifically, when the blank period BLANK corresponds to 32 lines and one frame period corresponds to 800 lines (768+32), the number of the illuminating frame lines corresponding to the lighting period ON of each of the backlights BL1 to BL4 is set to 200 lines (192+32/4). When the blank period BLANK corresponds to 128 lines and one frame period corresponds to 896 lines (768+128), the number of the illuminating frame lines is set to 224 lines (192+128/4). Then, the ON/OFF timing calculating unit 28A calculates the horizontal line numbers at which each of the backlights BL1 to BL4 is turned on and off to output the calculated values as a line signal LINE for each of the backlights BL1 to BL4.

Figure 10:
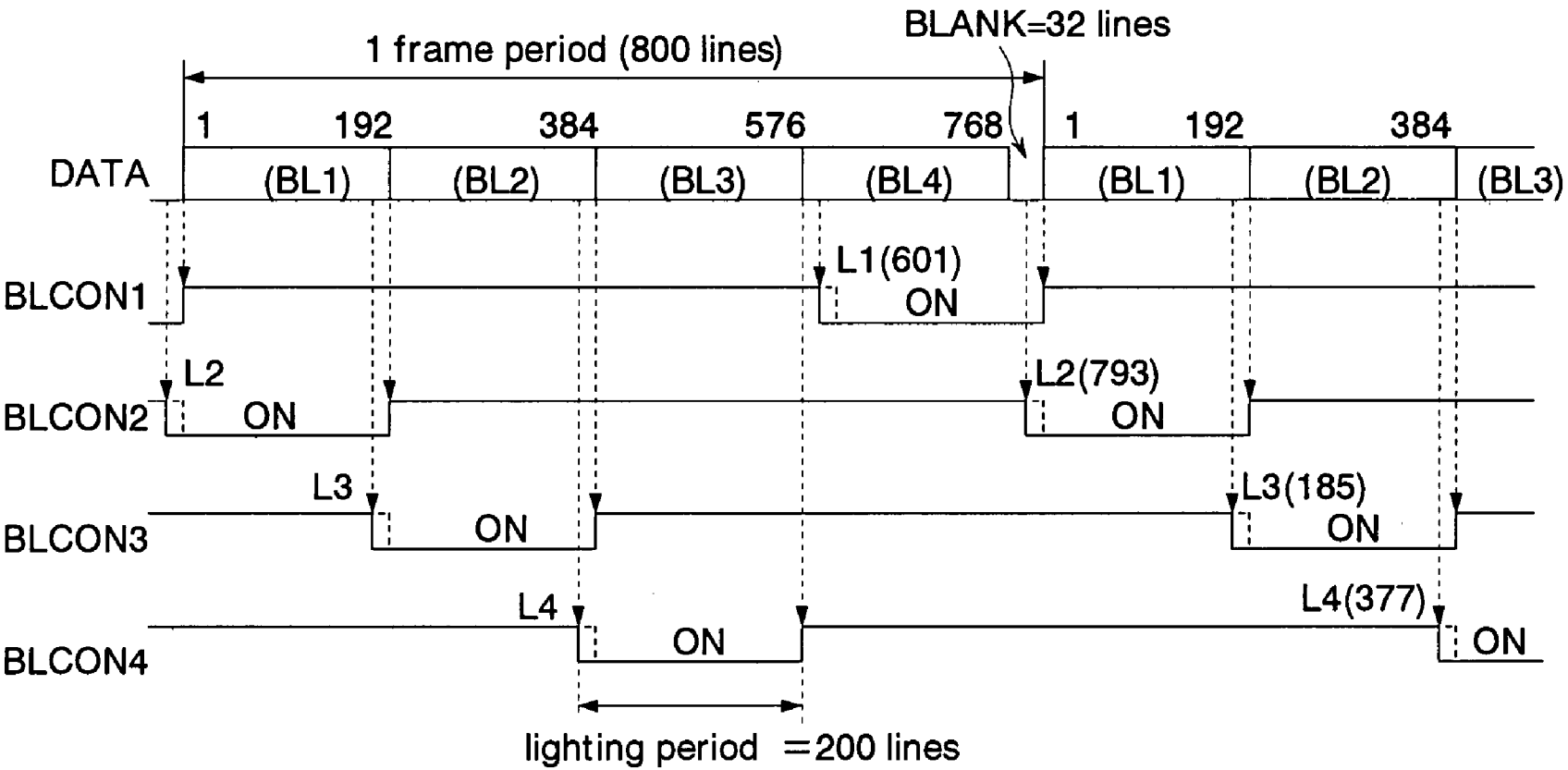
FIG. 10 is a timing chart showing one example of on/off control of backlights in the second embodiment.

FIG. 10 shows one example of on/off control of the backlights BL1 to BL4 in the second embodiment. The enable signal ENAB is supplied to a liquid crystal display device at the same timing as that in FIG. 7 in the first embodiment. Specifically, the blank period BLANK corresponds to 32 lines and one frame period corresponds to 800 lines (768+32). In this embodiment, the lighting periods of the backlights BL1 to BL4 changes according to the blank period BLANK. Therefore, the lighting period ON of each of the backlights BL1 to BL4 is set to 200 lines (192+32/4). This means that the lighting period ON of each of the backlights BL1 to BL4 is set to 25% (200/800) of one frame period. Specifically, the horizontal line numbers signifying the turning-on timing and the turning-off timing of the backlights BL1 to BL4 ("on lines, off lines) are "601, 1", "793, 193", "185, 385", and "377, 577" respectively. Falling edges, which are shown by the broken lines in the drawing, of backlight control signals BLCON1 to BLCON4 are those when the lighting period ON corresponds to 192 lines (the first embodiment).

Figure 11:
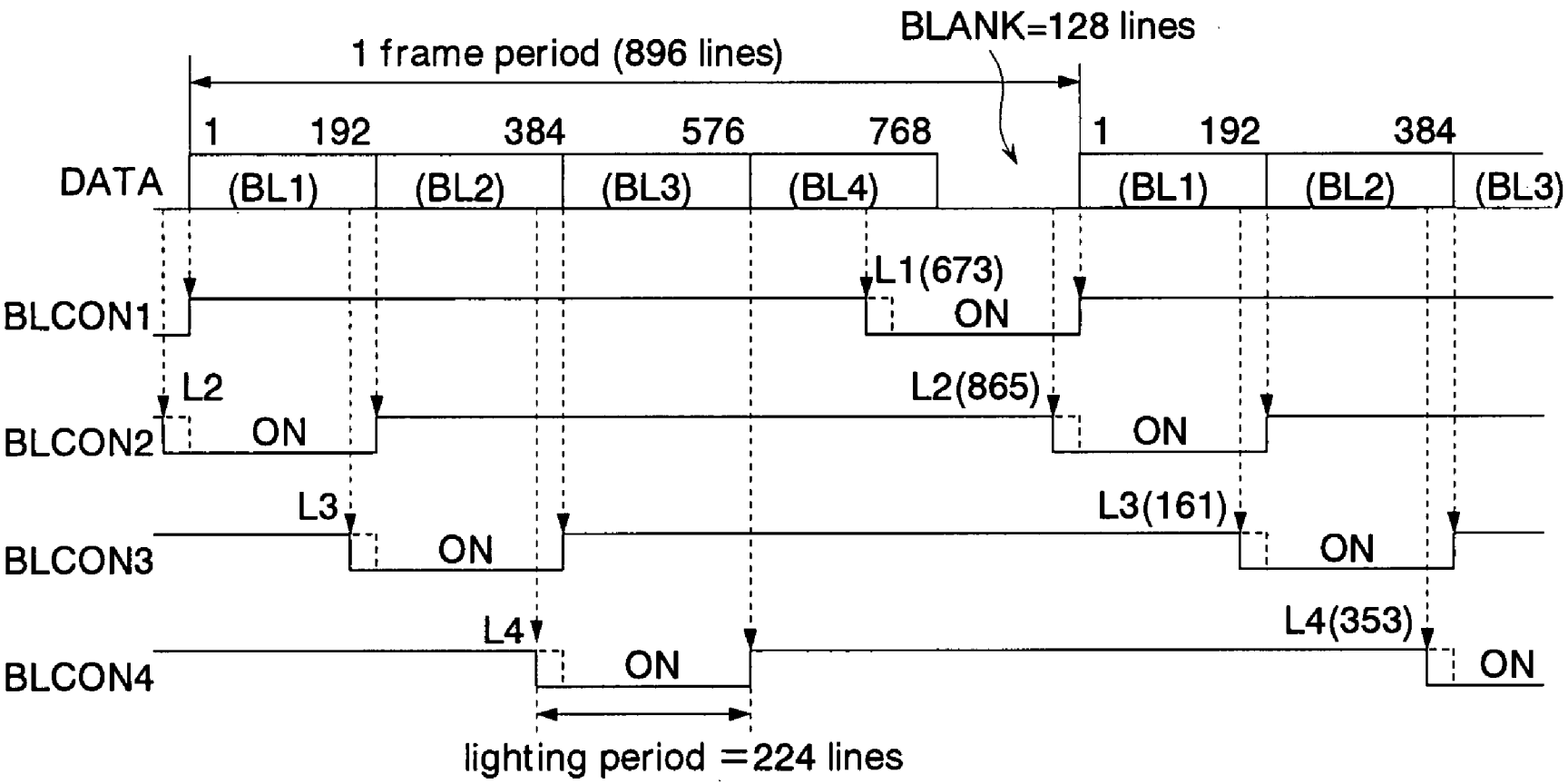
FIG. 11 a timing chart showing another example of the on/off control of the backlights in the second embodiment.

FIG. 11 shows another example of the on/off control of the backlights BL1 to BL4 in the second embodiment. The enable signal ENAB is supplied to the liquid crystal display device at the same timing as that in FIG. 8 in the first embodiment. Therefore, in this example, the blank period BLANK is changed from 32 lines to 128 lines by the operation of a user of a personal computer to which the liquid crystal display device of the present invention is connected. Therefore, the lighting period ON of each of the backlights BL1 to BL4 is set to 224 (192+128/4). This means that the lighting period ON of each of the backlights BL1 to BL4 is set to 25% (224/896) of one frame period. Specifically, the horizontal line numbers signifying the turning-on timings and the turning-off timings of the backlights BL1 to BL4 ("the on lines, the off lines") are "673, 1", "865, 193", "161, 385", and "353, 577" respectively. Falling edges, which are shown by the broken lines in the drawings, of the backlights control signals BLCON1 to BLCON4 are those when the lighting period ON corresponds to 192 lines (the first embodiment).

In the above-described manner, the lighting period ON of each of the backlights BL1 to BL4 is constantly set to 25% of one frame period in this embodiment. As a result, the lighting period ON of each of the backlights BL1 to BL4 is prevented from changing even when the blank period BLANK changes, so that change in brightness of the backlights BL1 to BL4 is prevented.

The same effects as those of the first embodiment described above are also obtainable in this embodiment. Further, in this embodiment, the number of the horizontal lines signifying the blank period BLANK is quartered to be included in the lighting periods ON of the backlights BL1 to BL4, so that the ratio of the lighting period ON to one frame period can be always made constant even when the blank period BLANK changes. If one frame period is the same, the lighting period ON is constant. In this case, change in brightness due to the change in the blank period BLANK can be eliminated.

Figure 12:
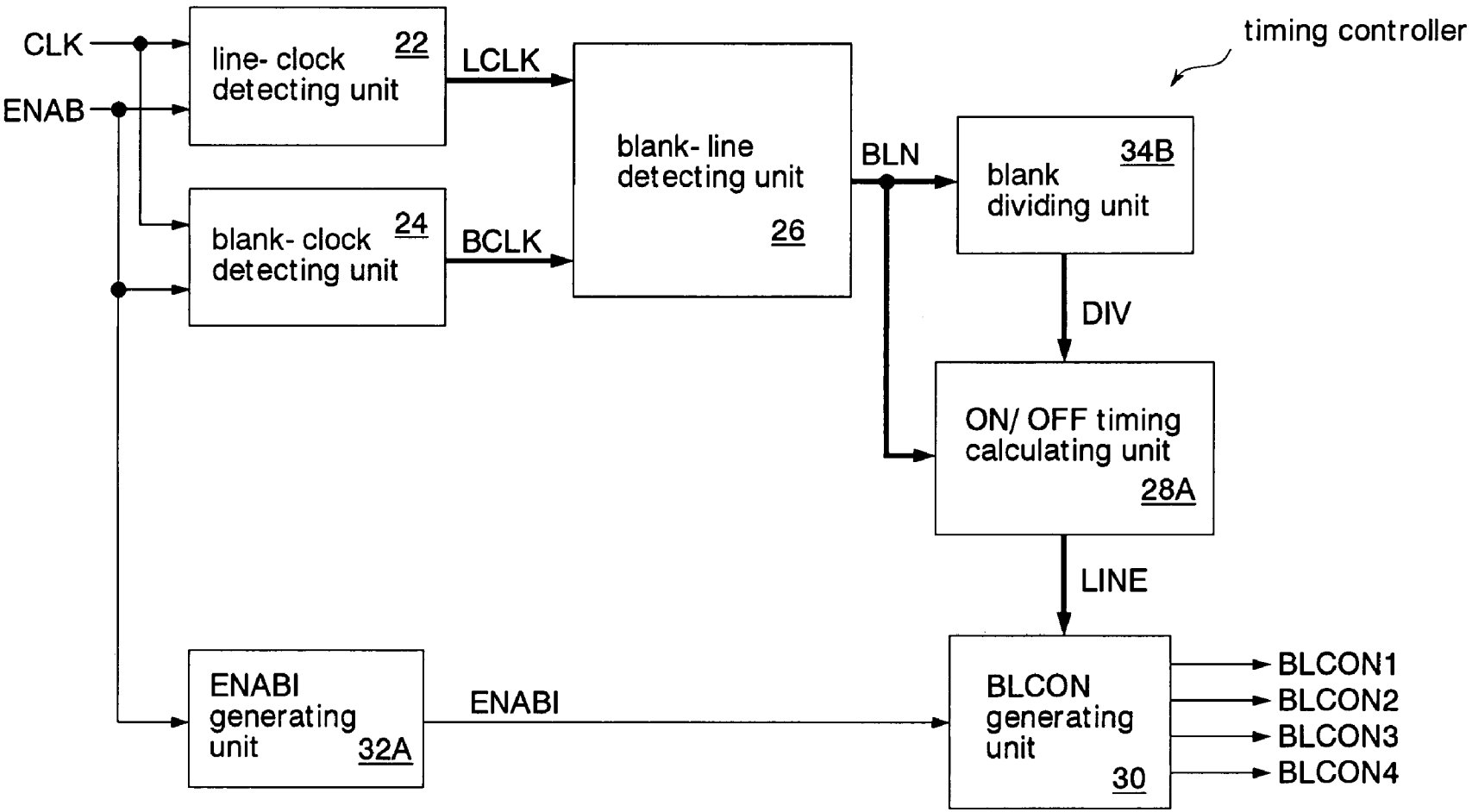
FIG. 12 is a block diagram showing a third embodiment of the present invention.

FIG. 12 shows a third embodiment of the present invention. The same reference numerals and symbols are used to designate the same elements as those explained in the first and second embodiments, and detailed explanation thereof will be omitted. In this embodiment, a timing controller is different from the timing controller 10 of the first embodiment. The other configuration is the same as that of the first embodiment. Therefore, only the timing controller is shown in FIG. 12.

The timing controller has a blank dividing unit 34B in place of the blank dividing unit 34A of the timing controller of the second embodiment. The other configuration is substantially the same as that of the timing controller of the second embodiment. In addition to the function of the blank dividing unit 34A of the second embodiment, the blank dividing unit 34B has a rounding-off function when the number of horizontal lines indicated by a blank-line signal BLN is not dividable by 4. The rounding-off can minimize the load on an ON/OFF timing calculating unit 28A and simplify circuitry. The simplified circuitry makes it possible to reduce power consumption while the timing controller is in operation.

Figure 13:
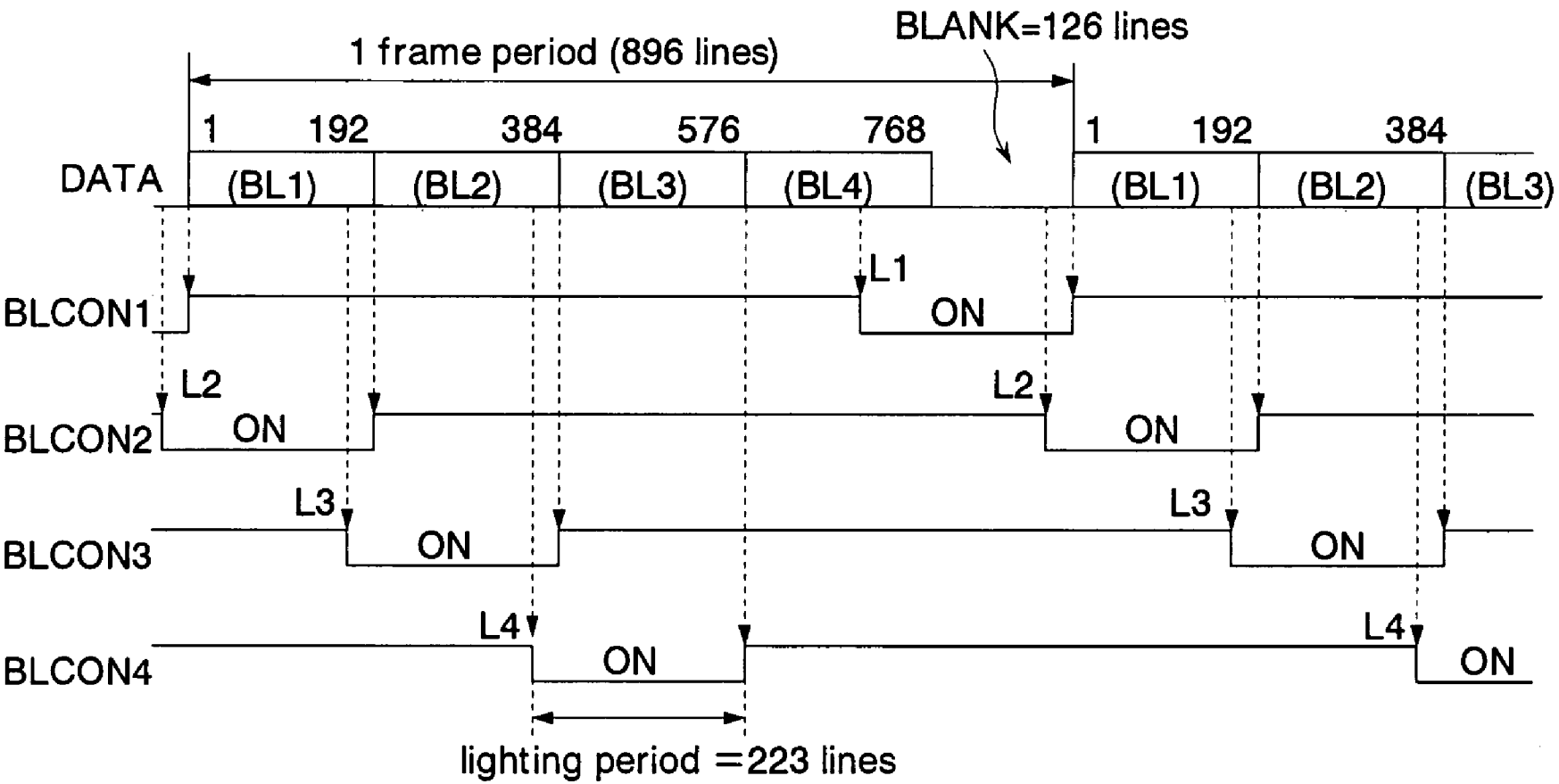
FIG. 13 is a timing chart showing one example of on/off control of backlights in the third embodiment.

FIG. 13 shows an example of on/off control of backlights BL1 to BL4 in the third embodiment. In this example, a blank period BLANK corresponds to 126 lines, and one frame period corresponds to 894 lines (768+126). At this time, the blank dividing unit 34B shown in FIG. 12 receives a blank-line signal BLN indicating 126 lines to execute division (126/4). Since the operation result has a remainder, the blank dividing unit 34B rounds off this remainder, so that the number of horizontal lines of the blank period BLANK allotted to each of the backlights BL1 to BL4 is set to 31 lines. As a result, a lighting period ON of each of the backlights BL1 to BL4 is set to 223 lines (192+31).

When the blank period BLANK changes from the state shown in FIG. 10 described above to the state shown in FIG. 13, the lighting period ON of each of the backlights BL1 to BL4 also changes from 25% (200/800) to 24.9% (223/894) of one frame period. However, even the 0.1% change in the lighting period ON causes little change in brightness of the backlights BL1 to BL4. Therefore, the change in brightness of a liquid crystal panel is not recognizable by a user.

The same effects as those of the first and second embodiments described above are also obtainable in this embodiment. Further, owing to the rounding-off process at the time when the horizontal lines of the blank period BLANK are allotted to the backlights BL1 to BL4, it is possible to reduce load on the circuits and simplify circuitry. Moreover, power consumption while the timing controller is in operation can be reduced.

Figure 14:
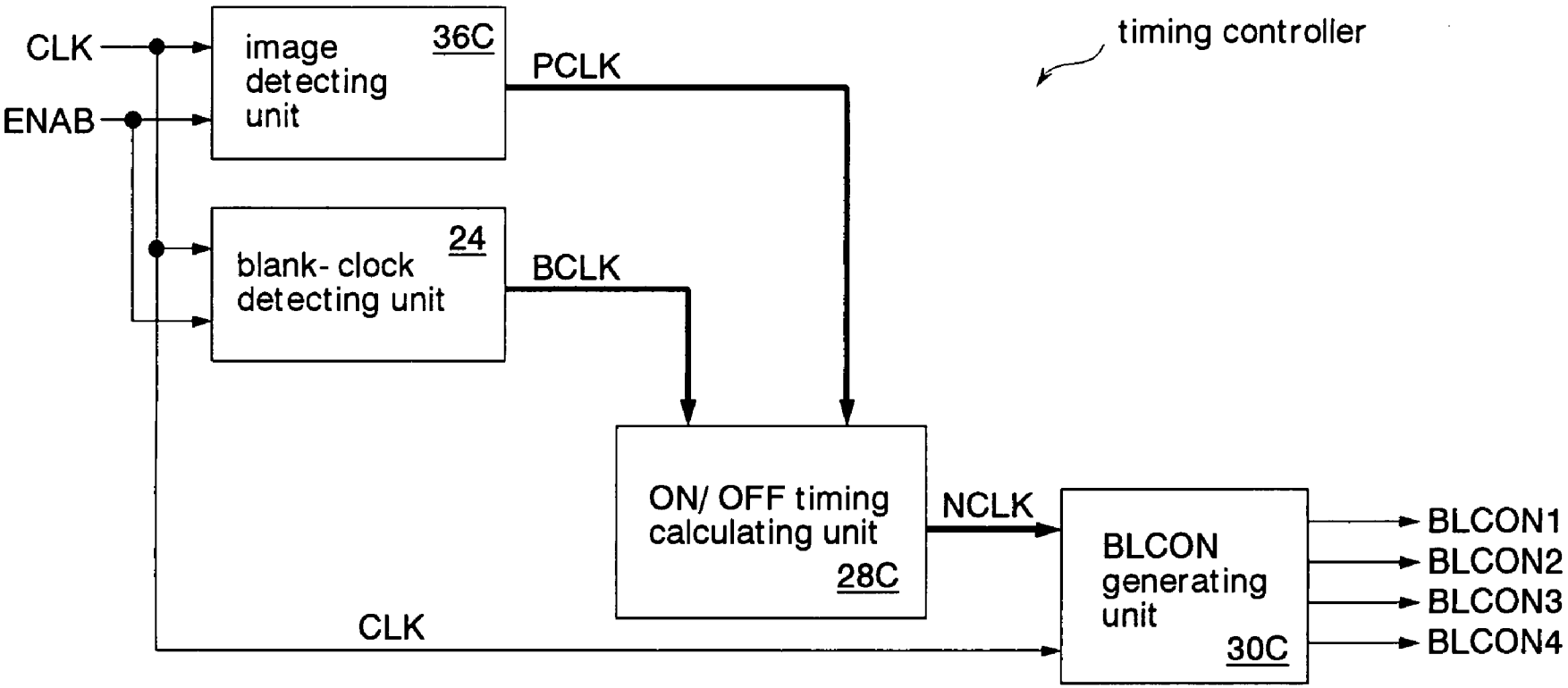
FIG. 14 is a block diagram showing a fourth embodiment of the present invention.

FIG. 14 shows a fourth embodiment of the present invention. The same reference numerals and symbols are used to designate the same elements as those explained in the first embodiment, and detailed explanation thereof will be omitted. In this embodiment, a timing controller is different from the timing controller 10 of the first embodiment. The other configuration is the same as that of the first embodiment. Therefore, only the timing controller is shown in FIG. 14.

The timing controller has an image detecting unit 36C, an ON/OFF timing calculating unit 28C, and a BLCON generating unit 30C in place of the line-clock detecting unit 22, the ON/OFF timing calculating unit 28, and the BLCON generating unit 30 of the timing controller (FIG. 6) of the first embodiment. Further, the blank-line detecting unit 26 of the first embodiment is not formed. The other configuration is substantially the same as that of the timing controller of the first embodiment.

The image detecting unit 36C receives an enable signal ENAB and a clock signal CLK, to find a period (an image period) which is of one frame period, and during which a data signal DATA (an image signal) is transferred, using the number of clocks (the number of pulses) of the clock signal CLK. In other words, the number of the clocks of the image period is counted. The image detecting unit 36C outputs the found number of the clocks as an image clock signal PCLK. The image clock signal PCLK shows the found number of the clocks as a binary number.

The ON/OFF timing calculating unit 28C receives the image clock signal PCLK and a blank clock signal BCLK to calculate the turning-on timing and the turning-off timing of each of backlights BL1 to BL4.

Specifically, the ON/OFF timing calculating unit 28C first adds the number of the clocks indicated by the image clock signal PCLK and that indicated by the blank clock signal BCLK to find the number of clocks corresponding to one frame period. Next, the ON/OFF timing calculating unit 28C calculates clock numbers at which each of the backlights BL1 to BL4 turned on and off respectively to output the calculated values for each of the backlights BL1 to BL4 as a clock number signal NCLK. Here, the clock number (serial number) is assigned in each frame from "1" in sequence. Note that a lighting period ON of each of the backlights BL1 to BL4 is set as a fixed number of clocks in advance.

The BLCON generating unit 30C counts the clock signals CLK, and when the counted value matches the number of clocks indicated by the clock number signal NCLK, it causes a corresponding one of backlight control signals BLCON1 to BLCON4 to rise or fall in order to turn on or off a corresponding one of the backlights BL1 to BL4. A blank period BLANK is thus converted not to the number of horizontal lines but to the number of dot clocks in this embodiment. The on/off timings of the backlights BL1 to BL4 are set by the number of the dot clocks. This makes it possible to set the on-off timings of the backlights BL1 to BL4 with high precision.

Figure 15:
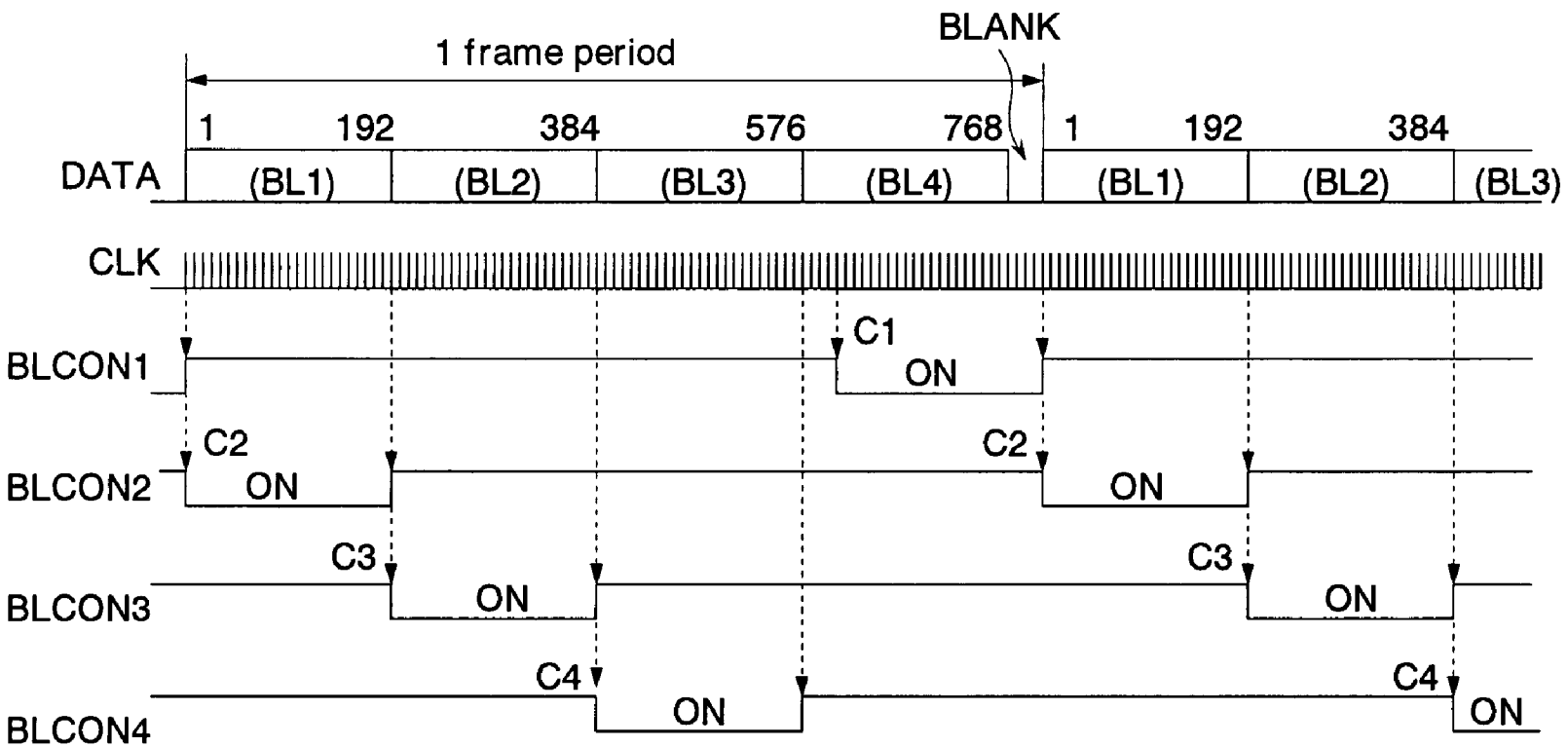
FIG. 15 is a timing chart showing one example of on/off control of backlights in the fourth embodiment.

FIG. 15 shows one example of on/off control of the backlights BL1 to BL4 in the fourth embodiment. In this example, the blank period BLANK is converted to the number of the clocks as described above. Then, the clock numbers signifying the turning-on timings of the backlights BL1 to BL4 are set to C1 to C4 respectively. The turning-off timings of the backlights BL1 to BL4 are similarly set. As a result, the lighting periods ON of the backlights BL1 to BL4 can be independent from the blank period BLANK and thus can be made equal to one another.

The same effects as those of the above-described first embodiment are also obtainable in this embodiment. Further, in this embodiment, more precise setting of the turning-on timing and the turning-off timing is possible since these timings are set not by the number of horizontal lines but by the number of the clocks (the number of the dot clocks). As a result, the lighting periods of the backlights BL1 to BL4 can be made equal to one another with high precision.

Figure 16:
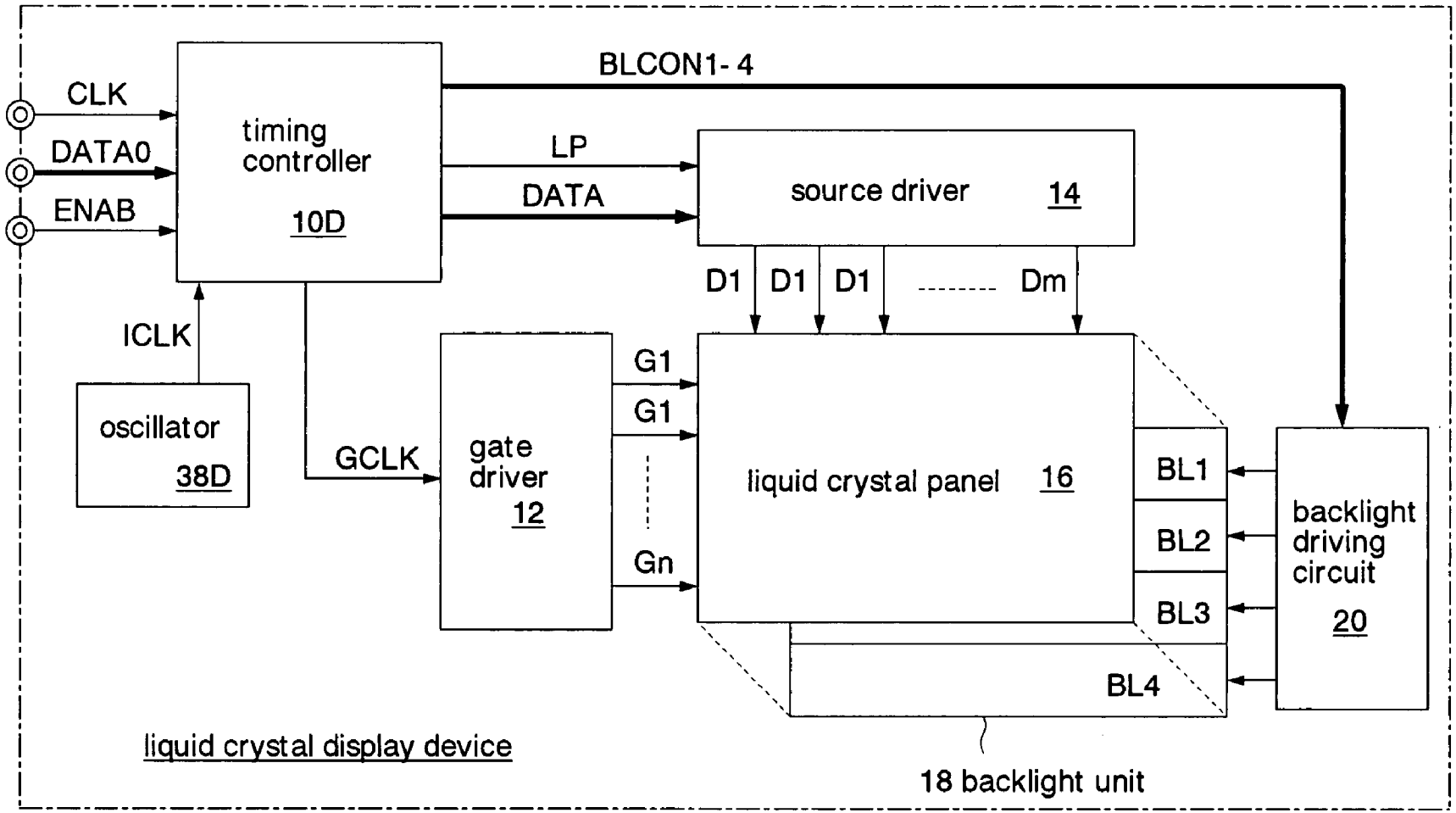
FIG. 16 is a block diagram showing a fifth embodiment of the present invention.

FIG. 16 shows a fifth embodiment of the present invention. The same reference numerals and symbols are used to designate the same elements as those explained in the first and fourth embodiments, and detailed explanation thereof will be omitted. A liquid crystal display device of this embodiment has a timing controller 10D in place of the timing controller 10 of the first embodiment. The liquid crystal display device further has an oscillator 38D. The oscillator 38D is constituted of, for example, a crystal oscillator and its control circuit, and it generates an internal clock signal ICLK with a frequency lower than that of a clock signal CLK supplied via an external terminal. The internal clock signal ICLK is supplied to the timing controller 10D. The configuration except the oscillator 38D and the timing controller 10D is the same as that of the first embodiment.

Figure 17:
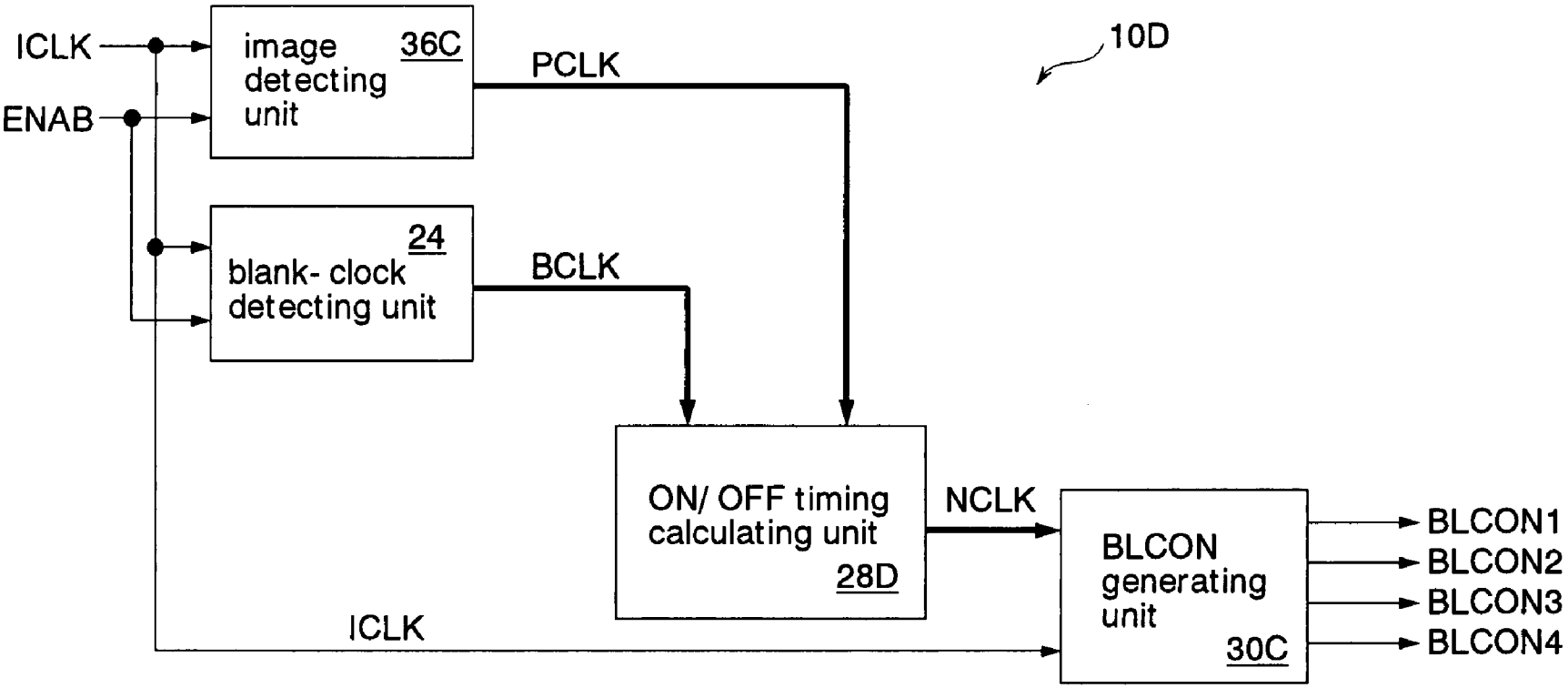
FIG. 17 is a block diagram showing a timing controller shown in FIG. 16 in detail.

FIG. 17 shows the timing controller 10D shown in FIG. 16 in detail. The timing controller 10D has an ON/OFF timing calculating unit 28D in place of the ON/OFF timing calculating unit 28C of the fourth embodiment. Further, the timing controller 10D receives the internal clock signal ICLK in place of the clock signal CLK of the fourth embodiment. The other configuration is substantially the same as that of the timing controller of the fourth embodiment.

The frequency of the internal clock signal ICLK is lower than the frequency of the clock signal CLK, so that the number of clocks indicated by an image clock signal PCLK outputted from an image detecting unit 36C and the number of clocks indicated by a blank-clock signal outputted from a blank-clock detecting unit 24 are smaller than those of the fourth embodiment. The frequency of the internal clock signal ICLK supplied to each of the circuits 36C, 24, 30C in the timing controller 10D is lower, so that the number of bits of a counter and so on counted by the clock signal can be reduced. As a result, circuit scale of these circuits can be reduced to reduce power consumption.

The internal clock signal ICLK is outputted from the oscillator 38D formed in the liquid crystal display device. Therefore, the frequency of the internal clock signal ICLK is independent from the frequency of the clock signal CLK supplied from an external part of the liquid crystal display device and thus is constant. The number of clocks of a lighting period ON that is set in advance in the ON/OFF timing calculating unit 28D is the number of clocks of the internal clock signal ICLK. As a result, the lighting periods ON of backlights BL1 to BL4 do not depend on the change in the frequency of the clock signal CLK and are thus always constant. The ON/OFF timing calculating unit 28D is designed to generate a clock number signal NCLK according to the frequency of the internal clock signal ICLK. The ON/OFF timing calculating unit 28D has the same basic function as that of the ON/OFF timing calculating unit 28C of the fourth embodiment.

The same effects as those of the first and fourth embodiments described above are also obtainable in this embodiment. Further, the turning-on timings and the turning-off timings of the backlights BL1 to BL4 are set by the number of the clocks of the internal clock signal ICLK in this embodiment, so that circuit scale of the timing controller 10D can be reduced to reduce power consumption. Further, the lighting periods ON of the backlights BL1 to BL4 can be kept constant, not depending on the frequency of the clock signal CLK. As a result, brightness of the backlights BL1 to BL4 can be made constant not only when a blank period BLANK changes but also when a frame period changes. Further, the frequency of the internal clock signal ICLK is set lower than the frequency of the clock signal CLK, so that circuit scale of the timing controller 10D can be made relatively small to enable relative reduction in power consumption.

Figure 18:
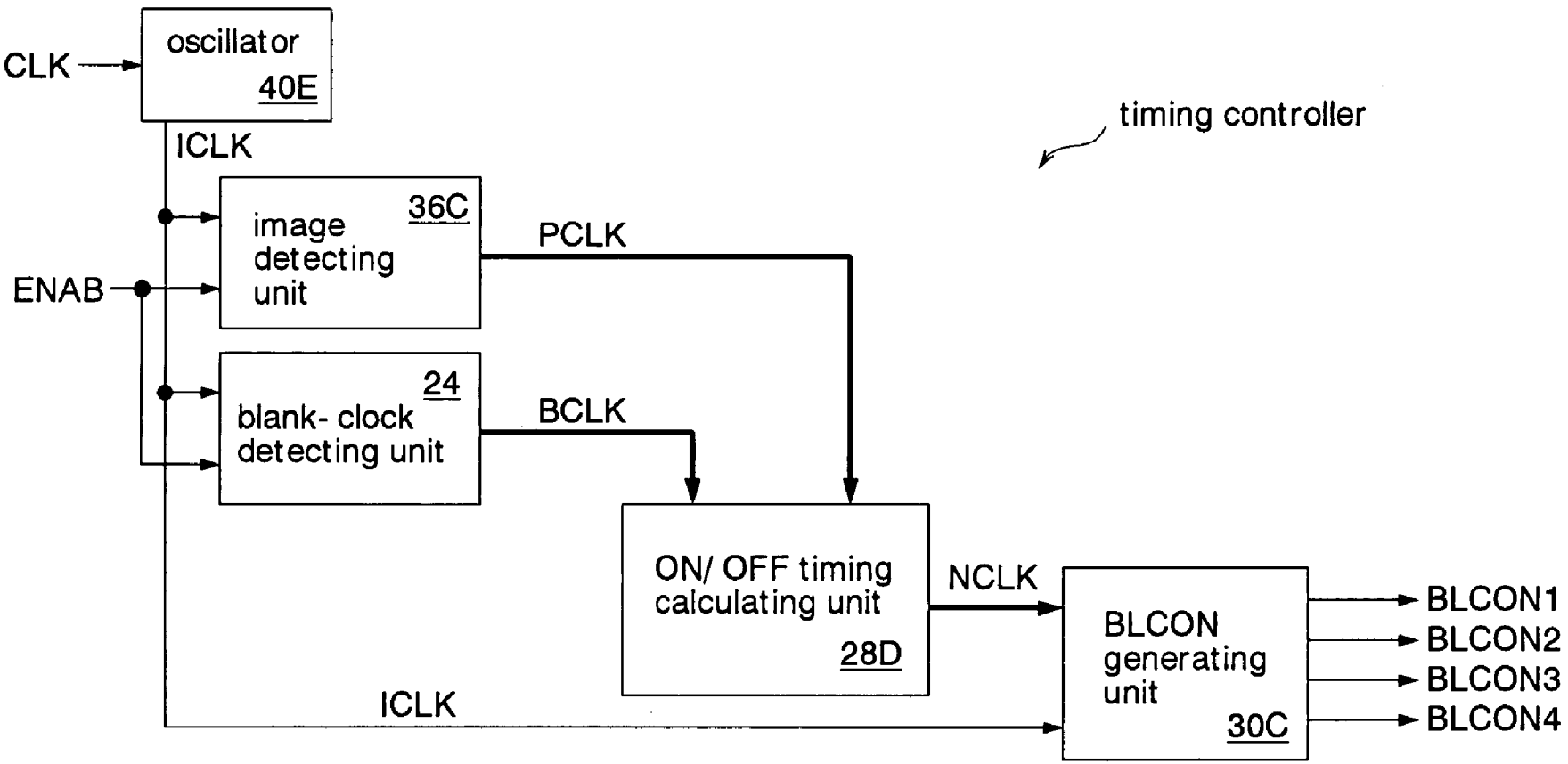
FIG. 18 is a block diagram showing a sixth embodiment of the present invention.

FIG. 18 shows a sixth embodiment of the present invention. The same reference numerals and symbols are used to designate the same elements as those explained in the first and fourth embodiments, and detailed explanation thereof will be omitted. In this embodiment, a timing controller is different from the timing controller 10 of the first embodiment. The other configuration is the same as that of the first embodiment. Therefore, only the timing controller is shown in FIG. 18.

The timing controller is configured such that a frequency divider 40E is added to the timing controller (FIG. 17) of the fifth embodiment. The frequency divider 40E divides the frequency of a clock signal CLK to generate an internal clock signal ICLK. The internal clock signal ICLK is supplied to an image detecting unit 36C, a blank-clock detecting unit 24, and a BLCON generating unit 30C. Incidentally, the frequency divider 40E may be formed outside the timing controller.

The same effects as those of the first and fifth embodiments described above are also obtainable in this embodiment. Further, in this embodiment, circuit scale of the timing controller can be made relatively small to enable relative reduction in power consumption, compared with a case where a clock signal CLK is used. Moreover, an expensive oscillator constituted of a crystal oscillator and so on is not required, which allows curtailed production cost of a liquid crystal display device.

Figure 19:
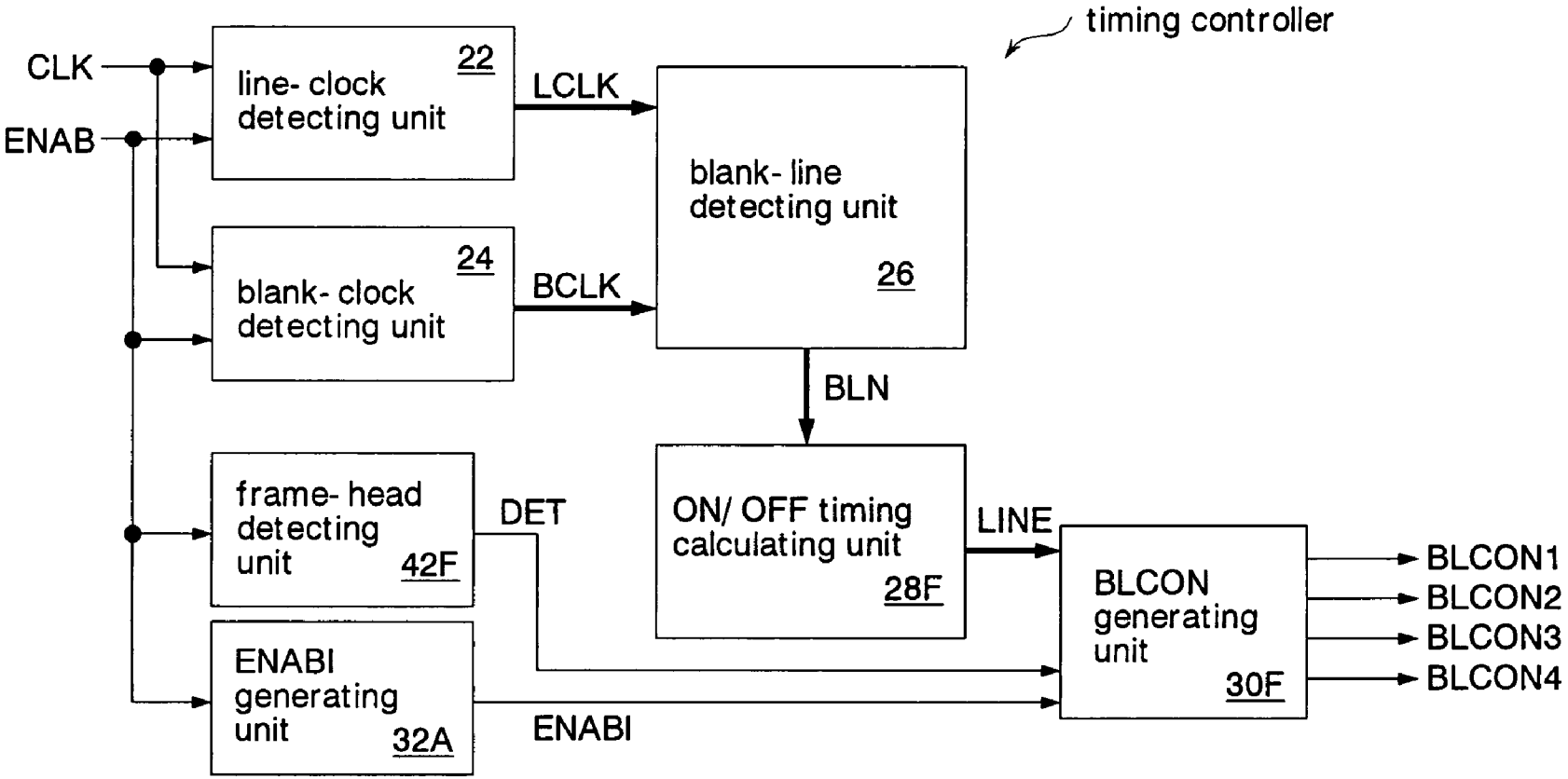
FIG. 19 is a block diagram showing a seventh embodiment of the present invention.

FIG. 19 shows a seventh embodiment of the present invention. The same reference numerals and symbols are used to designate the same elements as those explained in the first and fourth embodiments, and detailed explanation thereof will be omitted. In this embodiment, a timing controller is different from the timing controller 10 of the first embodiment. The other configuration is substantially the same as that of the first embodiment. Therefore, only the timing controller is shown in FIG. 19. Note that the turn-on level and the turn-off level of backlights BL1 to BL4 in this embodiment correspond to the maximum brightness and the minimum brightness (light out state) of fluorescent tubes. The same applies to an eighth embodiment to be described later.

The timing controller has an ON/OFF timing calculating unit 28F and a BLCON generating unit 30F in place of the ON/OFF timing calculating unit 28 and the BLCON generating unit 30 of the timing controller 10 (FIG. 6) of the first embodiment. The timing controller further has a frame-head detecting unit 42F and an ENABI generating unit 32A. The other configuration is substantially the same as that of the timing controller 10 of the first embodiment.

The frame-head detecting unit 42F detects the pulse of an enable signal ENAB first generated after a blank period BLANK, and outputs a detecting signal DET (pulse) in synchronization with this detection. The ENABI generating unit 32A outputs an internal enable signal ENABI synchronizing with the enable signal ENAB, also in the blank period BLANK, as in the second embodiment.

The ON/OFF timing calculating unit 28F sets the turning-off timing of each of backlights BL1 to BL4 so that brightness of each of the backlights BL1 to BL4 lowers to the turn-off level before data of a subsequent frame image is supplied to a pixel electrode PE. Specifically, the turning-off timing of each of the backlights BL1 to BL4 is set earlier by a transition period TP2 than the supply timing of the data of the subsequent frame image to the pixel electrode PE in each of four areas corresponding to the backlights BL1 to BL4 in a liquid crystal panel 16.

When receiving the detecting signal DET while the backlight BL1 is on, the BLCON generating unit 30F forcibly deactivates a backlight control signal BLCON1. This means that the backlight BL1 is turned off in synchronization with the detecting signal DET even when the BLCON generating unit 30F cannot find the horizontal line number at which the backlight BL1 is turned off.

Figure 20:
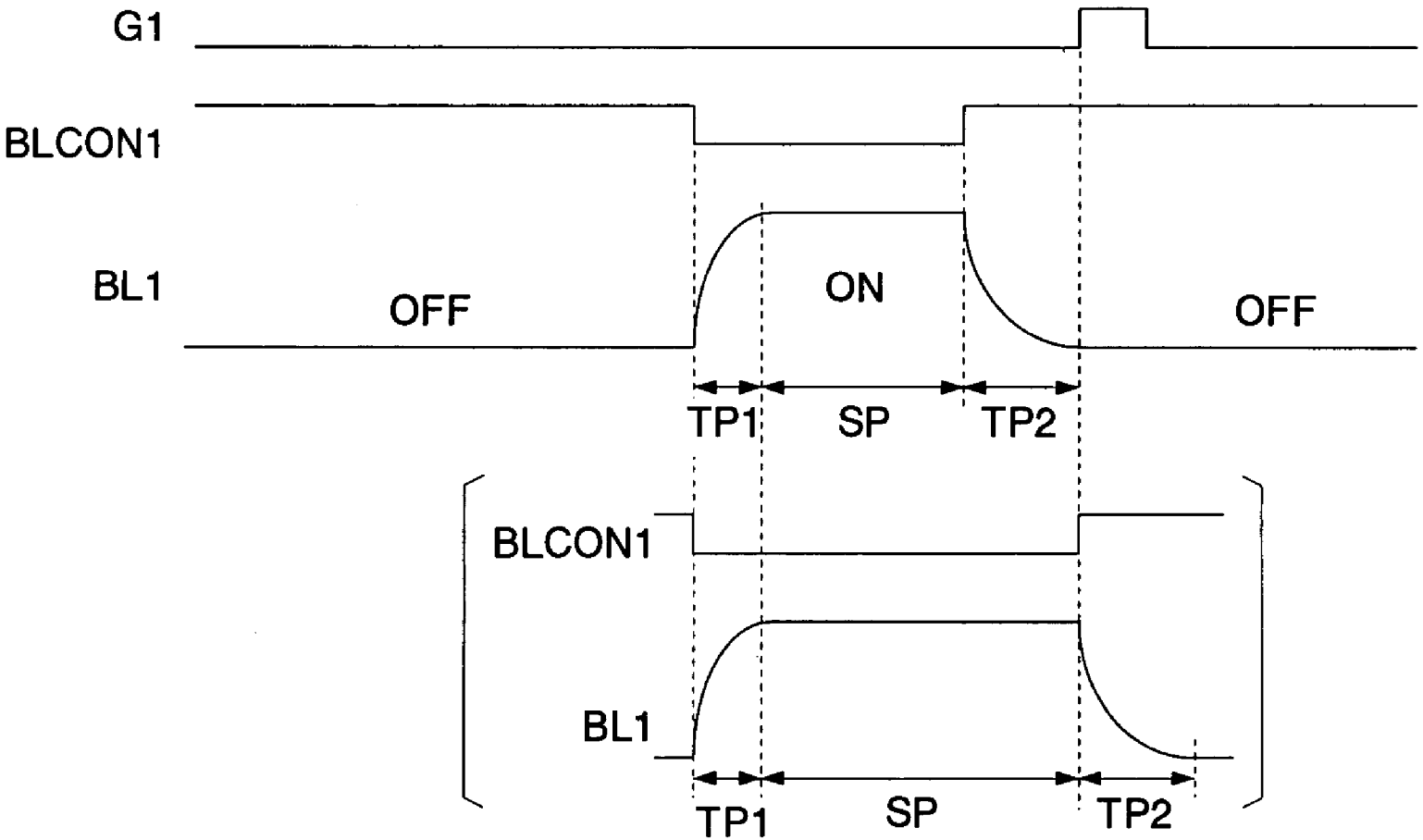
FIG. 20 is a waveform chart showing the turning-off timing of a backlight in the seventh embodiment.

FIG. 20 shows the turning-off timing of the backlight BL1 in the seventh embodiment. As described above, the turning-off timing of the backlight BL1 is earlier by the transition period TP2 of the backlight BL1 than the supply timing of the image signal of the subsequent frame to the pixel electrode PE (the pulse generation timing for a scanning line G1) (the same applies to the other backlights BL2 to BL4. Setting the turning-off timing earlier makes it possible to supply the image signal of the subsequent frame to liquid crystal cells C after one of the backlights BL1 to BL4 corresponding to the image of the subsequent frame completely turns off. This prevents the image of the subsequent frame to appear in an image of a preceding frame. When the turning-off timing of the backlights BL1 to BL4 is made to coincide with the supply timing of the image signal of the subsequent frame, the transition period TP2 enters the subsequent frame period as shown in the angle bracket in the drawing, so that the image of the subsequent frame appears in the image of the preceding frame. As a result, blur in a moving image occurs.

Figure 21:
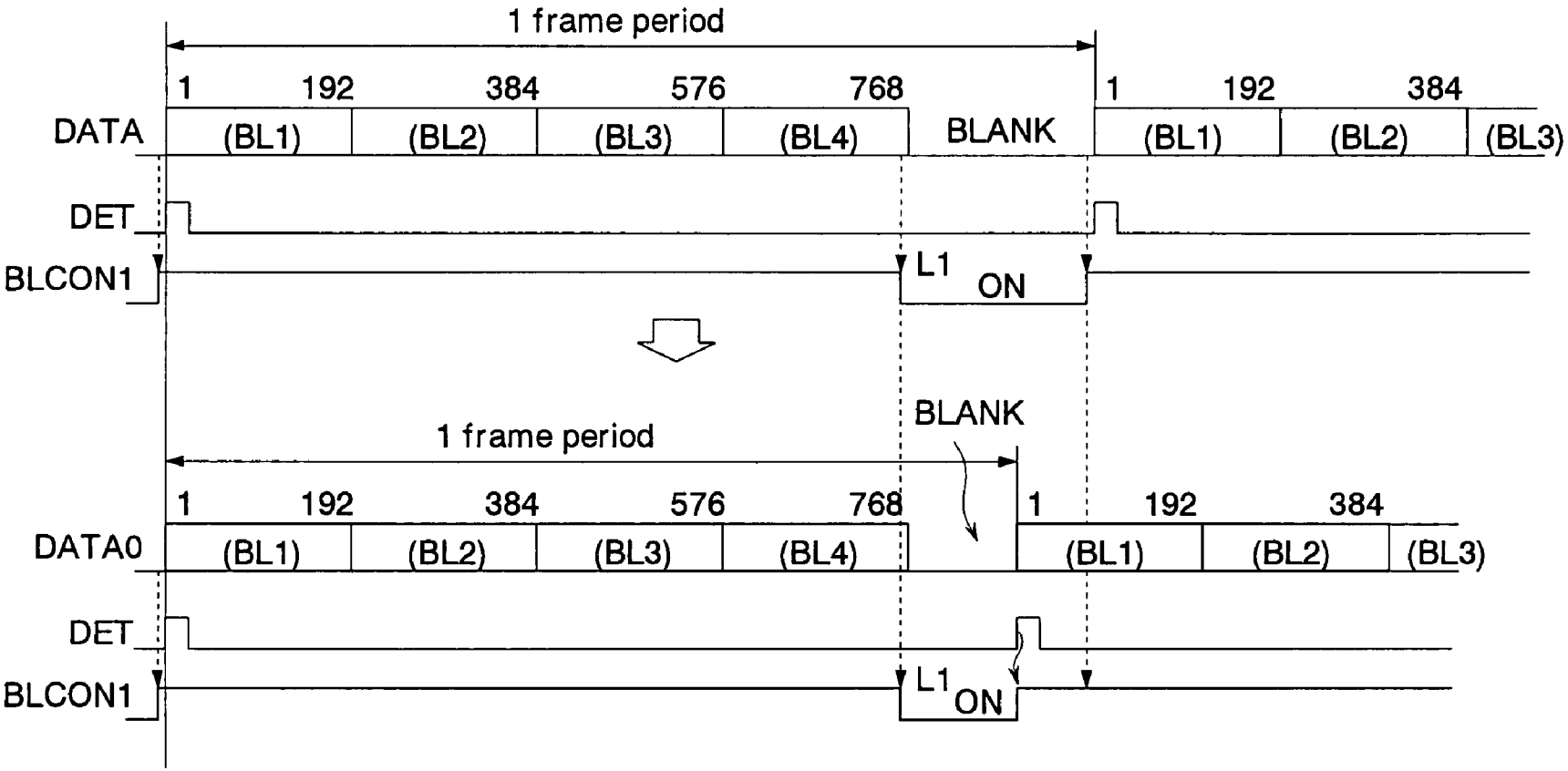
FIG. 21 is a timing chart showing one example of on/off control of backlights in the seventh embodiment.

FIG. 21 shows one example of on/off control of the backlights BL1 to BL4 in the seventh embodiment. An example where the blank period BLANK becomes shorter according to the reduction of one frame period is shown in the drawing. Since the pulse interval of the enable signal ENAB does not change, the display period of each horizontal line does not change. When one frame period is shortened by a control device that controls the operation of a liquid crystal display device, the line signal LINE (FIG. 19) indicating the horizontal line number at which the backlight BL1 is turned off is not generated. Therefore, the BLCON generating unit 30F cannot deactivate the backlight control signal BLCON1. However, the BLCON generating unit 30F can deactivate the backlight control signal BLCON1 in synchronization with the detecting signal DET that is outputted in synchronization with the start of the subsequent frame. In this manner, the backlight BL1 turns off in synchronization with an earlier timing between the turning-off timing (the turn-off line number) found by the ON/OFF timing calculating unit 28F and the output timing of the detecting signal DET. As a result, even in a case where one frame period gets shorter, it can be prevented that the backlight BL1 keeps illuminating in the subsequent one frame period, which can prevent momentary increase in brightness of the backlight BL1.

The same effects as those in the above-described first embodiment are also obtainable in this embodiment. Further, in this embodiment, the display of an image of the subsequent frame during the display of an image of the preceding frame can be prevented. As a result, blur of a moving image and so on can be prevented. Moreover, the backlight BL1 can be turned off without fail by the detecting signal DET even when the blank period BLANK gets shorter in accordance with the reduction in one frame period. As a result, it can be prevented that only the backlight BL1 keeps illuminating during one frame period. In other words, difference in brightness of the backlights can be prevented.

Figure 22:
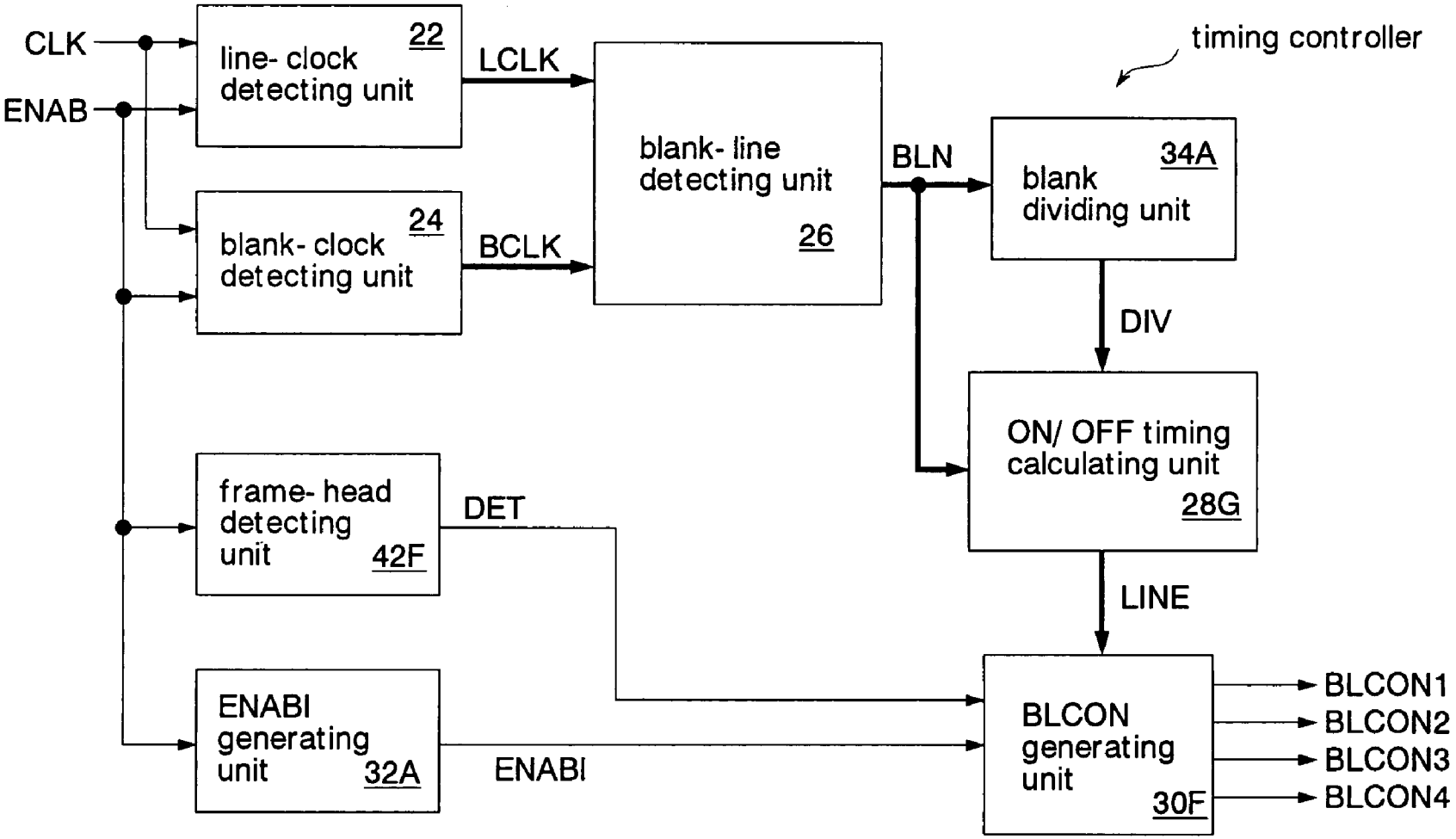
FIG. 22 is a block diagram showing an eighth embodiment of the present invention.

FIG. 22 shows an eighth embodiment of the present invention. The same reference numerals and symbols are used to designate the same elements as those explained in the first, second, and seventh embodiments, and detailed explanation thereof will be omitted. In this embodiment, a timing controller is different from the timing controller 10 of the first embodiment. The other configuration is the same as that of the first embodiment. Therefore, only the timing controller is shown in FIG. 22.

The timing controller has an ON/OFF timing calculating unit 28G in place of the ON/OFF timing calculating unit 28F of the timing controller (FIG. 6) of the seventh embodiment. The timing controller further has a blank dividing unit 34A. The other configuration is substantially the same as that of the timing controller of the seventh embodiment.

The ON/OFF timing calculating unit 28G is formed to have, in addition to the function of the ON/OFF timing calculating unit 28F of the seventh embodiment, the function of the ON/OFF timing calculating unit 28A of the second embodiment. Therefore, the ON/OFF timing calculating unit 28G sets the turning-off timing of each of backlights BL1 to BL4 earlier than the supply timing of an image signal of the subsequent frame to a pixel electrode PE, and equally allots a blank period BLANK to lighting periods ON of the backlights BL1 to BL4. Incidentally, similarly to the third embodiment, the blank dividing unit 34A may execute rounding-off when the number of horizontal lines indicated by a blank-line signal BLN is not dividable by 4.

The same effects as those of the first, second, and seventh embodiments described above are also obtainable.

Figure 23:
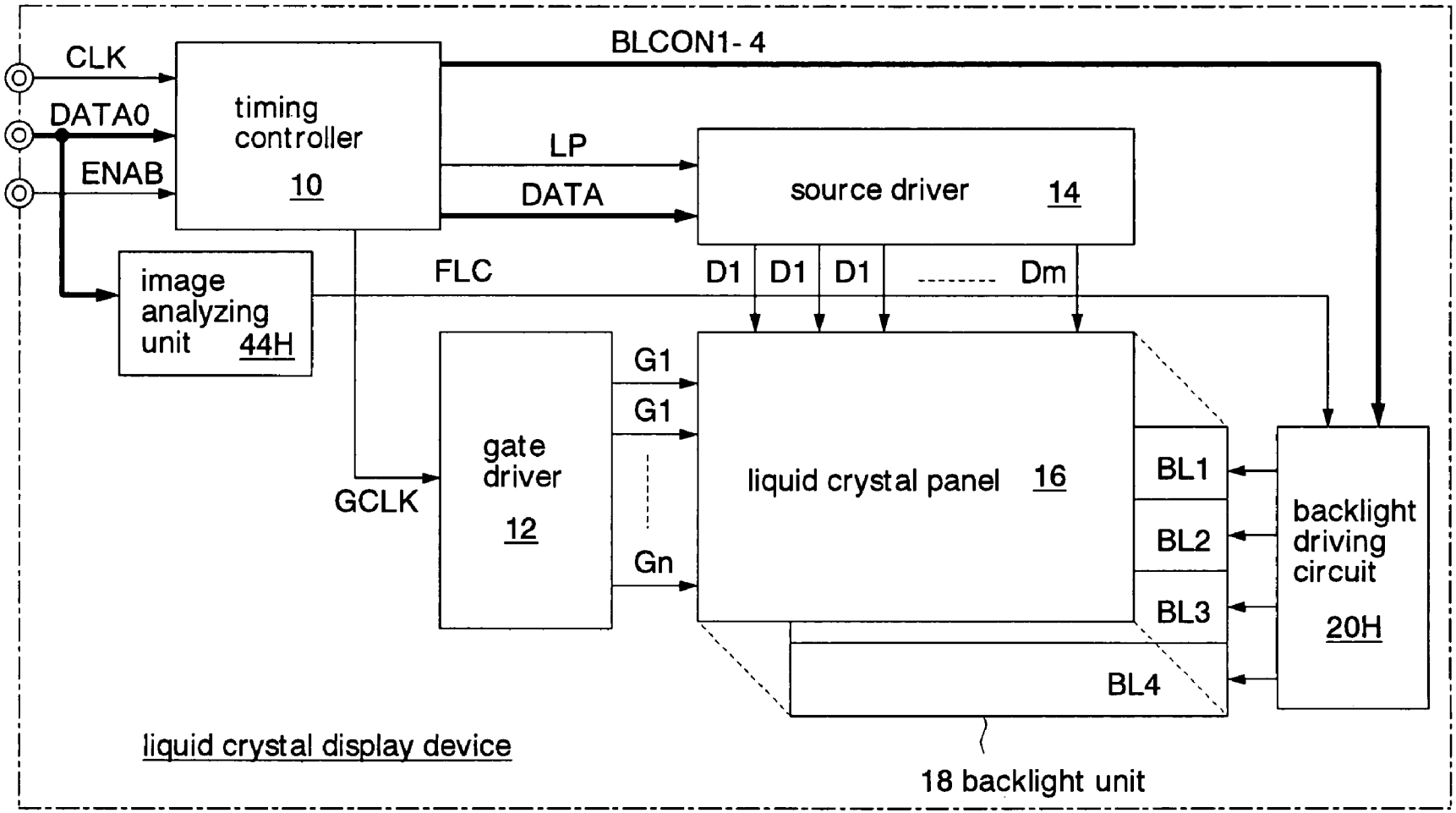
FIG. 23 is a block diagram showing a ninth embodiment of the present invention.

FIG. 23 shows a ninth embodiment of the present invention. The same reference numerals and symbols are used to designate the same elements as those explained in the first embodiment, and detailed explanation thereof will be omitted. A liquid crystal display device of this embodiment has a backlight driving circuit 20H in place of the backlight driving circuit 20 of the liquid crystal display device of the first embodiment. The liquid crystal display device further has an image analyzing unit 44H. The configuration except the backlight driving circuit 20H and the image analyzing unit 44H is the same as that of the first embodiment.

When judging that a data signal DATA0 (image signal) supplied from an external part of the liquid crystal display device via an external terminal is a still image, or when judging that images of a plurality of frames displayed in a predetermined pixel area of one screen are in one color or in similar colors, the image analyzing unit 44H activates a flicker preventing signal FLC. The backlight driving circuit 20H stops on/off control (turn on/off mode) of backlights BL1 to BL4 during a period in which the flicker preventing signal FLC is activated, and keeps the backlights BL1 to BL4 illuminating with predetermined brightness (a turning on mode). In other words, when images of the plural frames are in small motion, the turn on/off mode is changed to the turning-on mode. For example, brightness of the backlights BL1 to BL4 during the turning on mode is set to 80% of the maximum brightness. Since the on/off driving of the backlights BL1 to BL4 is not executed during the turning on mode, the occurrence of flicker due to on/off of the backlights BL1 to BL4 is prevented.

The same effects as those of the above-described first embodiment are also obtainable in this embodiment. Further, in this embodiment, the turning on mode is provided, which can prevent flicker from occurring when an image with small motion is displayed.

Figure 24:
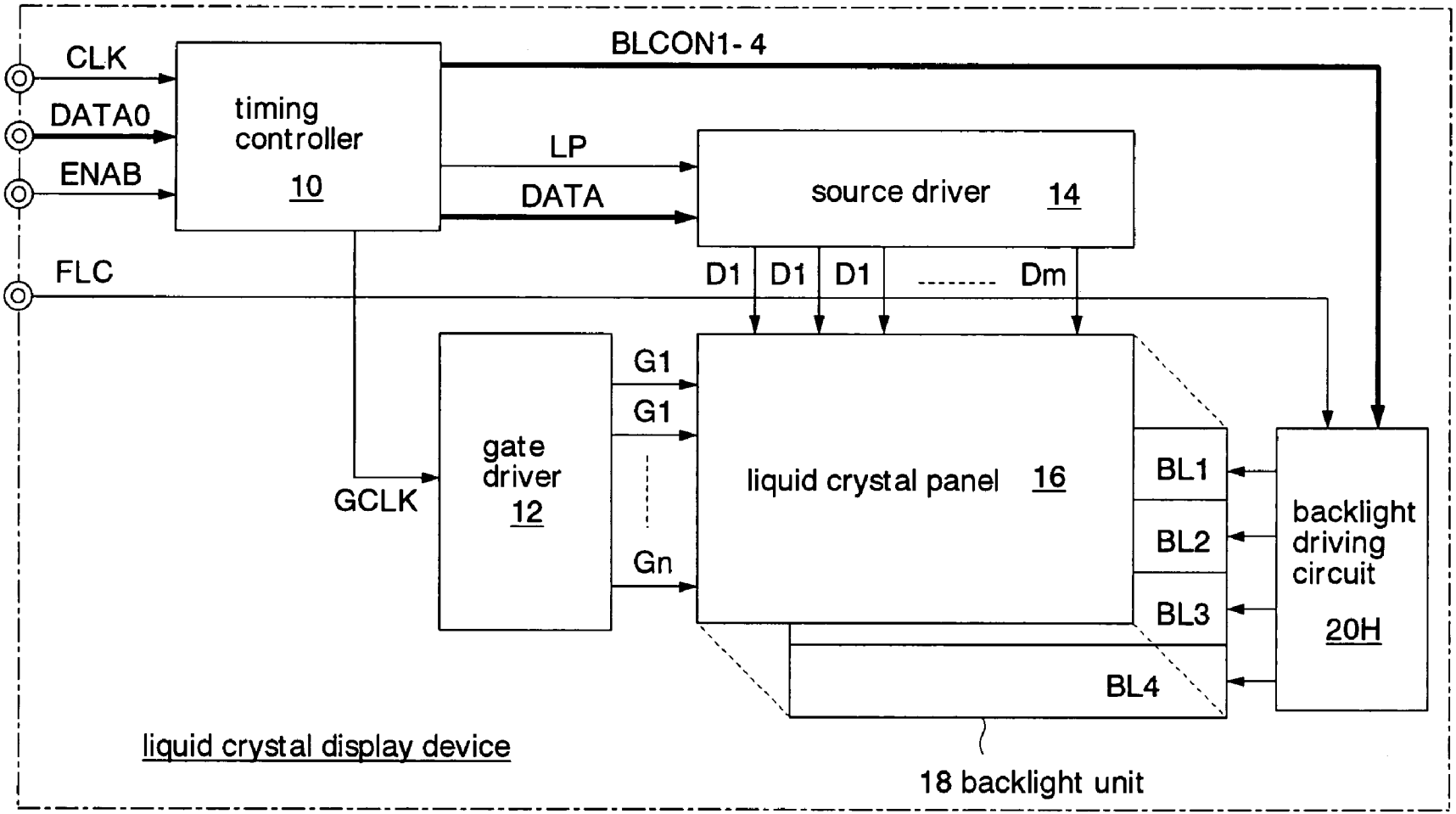
FIG. 24 is a block diagram showing a tenth embodiment of the present invention.

FIG. 24 shows a tenth embodiment of the present invention. The same reference numerals and symbols are used to designate the same elements as those explained in the first and ninth embodiments, and detailed explanation thereof will be omitted. A liquid crystal display device of this embodiment has a backlight driving circuit 20H in place of the backlight driving circuit 20 of the liquid crystal display device of the first embodiment. Further, the liquid crystal display device receives from an external part of the liquid crystal display device a flicker preventing signal FLC indicating an image with small motion. Specifically, in response to the flicker preventing signal FLC generated by an external control device, the liquid crystal display device shifts from a turn on/off mode to a turning on mode and backlights BL1 to BL4 keep illuminating with predetermined brightness. The other configuration is the same as that of the ninth embodiment.

The same effects as those in the first and ninth embodiments described above are also obtainable in this embodiment.

Incidentally, in the examples explained in the above-described embodiments, the present invention is applied to the liquid crystal display device receiving the enable signal ENAB from the control device such as a personal computer. The present invention is not to be limited to such embodiments. For example, the present invention may be applied to a liquid crystal display device receiving a horizontal synchronous signal HSYNC and a vertical synchronous signal VSYNC from a control device. In this case, the present invention is realizable by the use of the horizontal synchronous signal HSYNC in place of the enable signal ENAB.

In the examples described in the first to sixth, ninth, and tenth embodiments described above, the fluorescent tubes are on with the maximum brightness while the backlights BL1 to BL4 are on and with 5% brightness of the maximum brightness when the backlights BL1 to BL4 are off. The present invention is not to be limited to such embodiments. For example, the fluorescent tubes may be turned off while the backlights BL1 to BL4 are off. Alternatively, the fluorescent tubes may be turned on with 90% brightness of the maximum brightness while the backlights BL1 to BL4 are on, so that the life span of the fluorescent tubes can be made longer. Brightness of the fluorescent tubes can be easily adjusted by the backlight driving circuit 20.

In the example described in the above-described third embodiment, the blank dividing unit 34B executes rounding-off when the number of the horizontal lines indicated by the blank-line signal BLN is not dividable by 4. The present invention is not to be limited to such an embodiment. For example, the blank dividing unit 34B may execute rounding-up.

The frame-head detecting unit 42F and the BLCON generating unit 30F of the above-described seventh embodiment may be provided in the liquid crystal display devices of the fourth to sixth embodiments.

The turning on mode of the above-described ninth and tenth embodiments may be provided in the liquid crystal display devices of the second to eighth embodiments.

What is claimed is:

1. A liquid crystal display device comprising:

a liquid crystal panel in which liquid crystal cells are arranged in intersecting areas of scanning lines and data lines, respectively;

a plurality of backlights disposed to face said liquid crystal panel and arranged in line in a wiring direction of the data lines;

external terminals receiving an image signal and a synchronous signal, respectively, the synchronous signal being for generation of a timing at which the scanning lines and the data lines are driven;

a timing controller adjusting a period during which said backlights illuminate so that said backlights have equal brightness with each other, when detecting, using the synchronous signal, a change in a blank period which is of one frame period for a display of one screen and during which the image signal is not transmitted; and a backlight driving circuit controlled by said timing controller and executing on/off control of said backlights.

2. The liquid crystal display device according to claim 1, wherein said timing controller comprises:

a blank-line detecting unit finding a number of blank lines which represent the blank period by a number of horizontal line periods that are generation cycles for the synchronous signal; and a timing calculating unit finding a number of frame lines corresponding to one frame period by adding the number of blank lines to a number of horizontal lines that is a number of the scanning lines, and thereby setting a turning-on and turning-off timings of said backlights using serial numbers assigned to the frame lines.

3. The liquid crystal display device according to claim 2, wherein:

said timing controller comprises a blank dividing unit finding a number of divided blank lines by dividing the number of blank lines by the number of backlights, the number of divided blank lines being the number of blank lines per one backlight;

a period during which each of the backlights illuminate is represented by a number of illuminating frame lines that is a difference between serial numbers indicating the turning-on and turning-off timings, respectively; and said timing calculating unit sets the number of illuminating frame lines to a sum of a preset number of lines and the number of divided blank lines.

4. The liquid crystal display device according to claim 3, wherein said blank dividing unit rounds off when there is a remainder after the division.

5. The liquid crystal display device according to claim 3, wherein said blank dividing unit rounds up when there is a remainder after the division.

6. The liquid crystal display device according to claim 2, further comprising an external terminal receiving an external clock signal for putting said timing controller into operation, wherein:

said timing controller comprises:

a line-clock detecting unit finding a length of the horizontal line period as a number of clocks of the external clock signal and outputting a line-clock signal indicating the number of clocks; and a blank-clock detecting unit finding a length of the blank period as the number of clocks of the external clock signal and outputting a blank-clock signal indicating the number of clocks; and said blank-line detecting unit sets a ratio BCLK/LCLK (integer) to the number of the blank lines where BCLK is the number of clocks indicated by the blank-clock signal and LCLK is the number of the clocks indicated by the line-clock signal.

7. The liquid crystal display device according to claim 6, wherein said line-clock detecting unit counts numbers of clocks in a plurality of horizontal line periods and outputs the line-clock signal indicating an average value of the numbers of clocks included in a predetermined range.

8. The liquid crystal display device according to claim 2, wherein said timing calculating unit sets turning-off timings of said backlights so that in respective display areas of said liquid crystal panel corresponding to said backlights, a brightness of the backlights lowers to that of a turn-off level before a display of an image signal of a subsequent frame is started.

9. The liquid crystal display device according to claim 8, further comprising a frame-head detecting unit outputting a detecting signal when detecting a head of each frame, wherein one of said backlights corresponding to a head horizontal line is turned off in synchronization with an earlier timing of the turning-off timing found by said timing calculating unit and an output timing of the detecting signal.

10. The liquid crystal display device according to claim 2, wherein said timing calculating unit keeps constant a difference between the serial numbers indicating the turning-off timing and the turning-on timing, respectively.

11. The liquid crystal display device according to claim 1, further comprising an external terminal receiving an external clock signal for putting said timing controller into operation, wherein said timing controller comprises:

an image detecting unit finding a length of an image period as the number of clocks of the external clock signal, the image period being of one frame period and a period during which the image signal is transmitted;

a blank-clock detecting unit finding a length of the blank period as the number of clocks of the external clock signal; and a timing calculating unit finding a number of frame clocks corresponding to one frame period by adding the number of clocks counted by said blank-clock detecting unit to the number of clocks counted by said image detecting unit, thereby setting a turning-on timing and a turning-off timing of each of said backlights using serial numbers assigned to the frame clocks.

12. The liquid crystal display device according to claim 11, wherein said timing calculating unit sets turning-off timings of said backlights so that in respective display areas of said liquid crystal panel corresponding to said backlights, a brightness of the backlights lowers to that of a turn-off level before a display of an image signal of a subsequent frame is started.

13. The liquid crystal display device according to claim 12, further comprising a frame-head detecting unit outputting a detecting signal when detecting a head of each frame, wherein one of said backlights corresponding to a head horizontal line is turned off in synchronization with an earlier timing of the turning-off timing found by said timing calculating unit and an output timing of the detecting signal.

14. The liquid crystal display device according to claim 11, wherein said timing calculating unit keeps constant a difference between the serial numbers indicating the turning-off timing and the turning-on timing, respectively.

15. The liquid crystal display device according to claim 1, further comprising an oscillator generating an internal clock signal, wherein said timing controller comprises:

an image detecting unit finding a length of an image period as the number of clocks of the internal clock signal, the image period being of one frame period and a period during which the image signal is transmitted;

a blank-clock detecting unit finding a length of the blank period as the number of clocks of the internal clock signal; and a timing calculating unit finding the number of frame clocks corresponding to one frame period by adding the number of clocks counted by said blank-clock detecting unit to the number of clocks counted by said image detecting unit, thereby setting a turning-on timing and a turning-off timing of each of said backlights using serial numbers assigned to the frame clocks.

16. The liquid crystal display device according to claim 15, further comprising an external terminal receiving an external clock signal for putting said timing controller into operation, wherein a frequency of the internal clock signal is set to a value lower than a frequency of the external clock signal.

17. The liquid crystal display device according to claim 15, wherein said timing calculating unit sets turning-off timings of said backlights so that in respective display areas of said liquid crystal panel corresponding to said backlights, a brightness of the backlights lowers to that of a turn-off level before a display of an image signal of a subsequent frame is started.

18. The liquid crystal display device according to claim 17, further comprising a frame-head detecting unit outputting a detecting signal when detecting a head of each frame, wherein one of said backlights corresponding to a head horizontal line is turned off in synchronization with an earlier timing of the turning-off timing found by said timing calculating unit and an output timing of the detecting signal.

19. The liquid crystal display device according to claim 15, wherein said timing calculating unit keeps constant a difference between the serial numbers indicating the turning-off timing and the turning-on timing, respectively.

20. The liquid crystal display device according to claim 1, further comprising:

an external terminal receiving an external clock signal for putting said timing controller into operation; and a frequency divider dividing a frequency of the external clock signal to generate an internal clock signal, wherein said timing controller comprises:

an image detecting unit finding a length of an image period as the number of clocks of the internal clock signal, the image period being of one frame period and a period during which the image signal is transmitted;

a blank-clock detecting unit finding a length of the blank period as the number of clocks of the internal clock signal; and a timing calculating unit finding the number of frame clocks corresponding to one frame period by adding the number of clocks counted by said blank-clock detecting unit to the number of clocks counted by said image detecting unit, thereby setting a turning-on timing and a turning-off timing of each of said backlights using serial numbers assigned to the frame clocks.

21. The liquid crystal display device according to claim 20, wherein said timing calculating unit sets turning-off timings of said backlights so that in respective display areas of said liquid crystal panel corresponding to said backlights, a brightness of the backlights lowers to that of a turn-off level before a display of an image signal of a subsequent frame is started.

22. The liquid crystal display device according to claim 21, further comprising a frame-head detecting unit outputting a detecting signal when detecting a head of each frame, wherein one of said backlights corresponding to a head horizontal line is turned off in synchronization with an earlier timing of the turning-off timing found by said timing calculating unit and an output timing of the detecting signal.

23. The liquid crystal display device according to claim 20, wherein said timing calculating unit keeps constant a difference between the serial numbers indicating the turning-off timing and the turning-on timing, respectively.

24. The liquid crystal display device according to claim 1, further comprising an image analyzing unit outputting a flicker preventing signal when an image formed of the image signals of a plurality of frames is in small motion, wherein said backlight driving circuit stops the on/off control in response to the output of the flicker preventing signal to allow said backlights to continue to illuminate with a predetermined brightness.

25. The liquid crystal display device according to claim 1, further comprising an external terminal receiving a flicker preventing signal indicating that an image formed of the image signals of a plurality of frames is in small motion, wherein said backlight driving circuit stops the on/off control in response to an output of the flicker preventing signal to allow said backlights to continue to illuminate with predetermined brightness.

26. The liquid crystal display device according to claim 1, wherein said backlight driving circuit allows said backlights to illuminate with maximum brightness when a backlight control signal for brightness adjustment supplied from said timing controller indicates turning-on.

27. The liquid crystal display device according to claim 1, wherein said backlight driving circuit allows said backlights to continue to illuminate with a low brightness when a backlight control signal for brightness adjustment supplied from said timing controller indicates turning-off.

* * * * *